US012232639B2

(12) United States Patent
Jüngst et al.

(10) Patent No.: US 12,232,639 B2
(45) Date of Patent: Feb. 25, 2025

(54) DRINKING APPARATUS AND DRINKING VESSEL

(71) Applicant: air up group GmbH, Munich (DE)

(72) Inventors: Magdalena Jüngst, Munich (DE); Jannis Koppitz, Munich (DE); Tim Jäger, Munich (DE); Fabian Schlang, Munich (DE)

(73) Assignee: air up group GmbH, Munich (DE)

( * ) Notice: Subject to any disclaimer, the term of this patent is extended or adjusted under 35 U.S.C. 154(b) by 0 days.

(21) Appl. No.: 18/017,363

(22) PCT Filed: Jul. 20, 2021

(86) PCT No.: PCT/EP2021/070240
§ 371 (c)(1),
(2) Date: Jan. 20, 2023

(87) PCT Pub. No.: WO2022/023119
PCT Pub. Date: Feb. 3, 2022

(65) Prior Publication Data

US 2023/0270270 A1 Aug. 31, 2023

(30) Foreign Application Priority Data

Jul. 30, 2020 (EP) ..... 20188639

(51) Int. Cl.
*A47G 21/18* (2006.01)
*A47G 19/22* (2006.01)

(52) U.S. Cl.
CPC ..... *A47G 21/18* (2013.01); *A47G 19/2266* (2013.01); *A47G 2400/04* (2013.01)

(58) Field of Classification Search
CPC .... A47G 21/18; A47G 21/183; A47G 21/184; A47G 21/185; A47G 21/186; A47G 19/2266; A47G 19/2272; A47G 2400/04
See application file for complete search history.

(56) References Cited

U.S. PATENT DOCUMENTS

2002/0036239 A1* 3/2002 Banach ..... A47G 21/18 239/24
2020/0178712 A1* 6/2020 Jäger ..... B65D 47/26
2022/0087456 A1 3/2022 Jäger

FOREIGN PATENT DOCUMENTS

DE 20 2017 000 239 U1 1/2017
DE 20 2018 000 382 U1 5/2018
(Continued)

OTHER PUBLICATIONS

PCT/EP2021/070240, Sep. 28, 2021, International Search Report and Written Opinion.
(Continued)

*Primary Examiner* — Javier A Pagan
(74) *Attorney, Agent, or Firm* — Wolf, Greenfield & Sacks, P.C.

(57) ABSTRACT

A drinking device comprises a drinking straw with an inner flow channel and a drinking end and an aroma container connected with the drinking straw for adding an aroma substance to an air flow flowing out of the aroma container. The aroma container comprises at least one air outlet opening which is in flow connection either with at least one aroma inlet opening into the inner flow channel or with an aroma channel extending up to the drinking end of the drinking straw. The aroma container is able to be coupled with the drinking straw in such a way that, when applying a negative pressure at the drinking end or at a mouthpiece connected with the drinking end, the air flow exits from the aroma container through the air outlet opening. The aroma container comprises an aroma chamber containing a carrier substance for an aroma substance, wherein the carrier substance preferably has a specific flow resistance of less than 500 Pa·s/m.

27 Claims, 18 Drawing Sheets

(56) References Cited

FOREIGN PATENT DOCUMENTS

| | | | | |
|---|---|---|---|---|
| DE | 10 2018 222 299 | A1 | 6/2020 | |
| EP | 2 215 936 | A1 | 8/2010 | |
| GB | 2 401 527 | A | 11/2004 | |
| WO | WO 2003/013977 | A1 | 2/2003 | |
| WO | WO 2019/016096 | A1 | 1/2019 | |
| WO | WO-2020054988 | A1 * | 3/2020 | ..... A47G 21/186 |

OTHER PUBLICATIONS

International Search Report and Written Opinion dated Sep. 28, 2021, in connection with International Application No. PCT/EP2021/070240.

* cited by examiner

A-A (1 : 1)

DRINKING APPARATUS AND DRINKING VESSEL

This Application is a national stage filing under 35 U.S.C. § 371 of International Patent Application Serial No. PCT/EP2021/070240, filed Jul. 20, 2021. Foreign priority benefits are claimed under 35 U.S.C. § 119 (a)-(d) or 35 U.S.C. § 365 (b) of European application no. 20188639.7, filed Jul. 30, 2020. The entire contents of these applications are incorporated herein by reference in their entirety.

FIELD OF THE INVENTION

The invention relates to a drinking device as well as a drinking vessel with such a drinking device.

PRIOR ART

There is an increasing need to ingest drinking liquids which on the one hand have a pleasant flavor but on the other prevent health risks which could be brought about by the ingestion of aroma substances or stabilizing agents dissolved in the drinking liquid. The ingestion of an increased quantity of calories is also to be avoided.

Water which has been given a slightly fruity aroma has therefore become popular in the last few years. However, undesired additives, such as stabilizing substances and a certain amount of sugar, are also contained in this aromatized water. Many users reject such drinks simply on account of this number of calories and dental hygiene.

Since the olfactory sensation plays a significant part in gustatory perception in the consumption of food and beverages, drinking systems to date have attempted to influence the smell perceived while drinking. To that end, aroma elements are proposed which can be attached close to the drinking opening on a drinking vessel so that the aroma element is in the immediate proximity of the nose of the user, who breathes through the nose while drinking and thereby perceives the aroma.

A drinking device for retronasal ingestion of an aroma substance, comprising an aroma container through which air can flow and which supplies aromatized air to a transport channel for drinking liquid, is known from WO 2019/016096 A1. In this way, the aroma substance is ingested retronasally. During drinking, the aroma substance reaches the mouth of the user together with the drinking liquid and subsequently rises retronasally via the pharynx to the olfactory mucosa, where it is detected by the receptors situated there and is perceived by the user. Advantage is taken of the fact that there is a close correlation between the sense of smell and the sense of taste. The user therefore gains the impression that they are tasting the aroma, even though they are in fact only smelling it retronasally.

DESCRIPTION OF THE INVENTION

The invention is based on the object of proposing a drinking device for adding an aroma substance, which is space-saving and can be used in a variety of ways.

This object is solved by a drinking device with the features of claim 1 as well as a drinking vessel with the features of claim 20.

Preferred embodiments are apparent from the other claims.

The drinking device according to the invention consists of a drinking straw and an aroma container. The drinking straw has an inner flow channel and a drinking end. The aroma container for dispensing an aroma substance to an air flow flowing out of the aroma container is fixedly, movably or detachably connected with the drinking straw. The aroma container comprises at least one air outlet opening which is in flow connection either with at least one aroma inlet opening into the inner flow channel of the drinking straw or with an aroma channel extending to the drinking end of the drinking straw. The aroma container is adapted to be able to be coupled with the drinking straw in such a way that, when applying a negative pressure at the drinking end of the drinking straw or when applying a negative pressure at a mouthpiece arranged at the drinking end of the drinking straw, the air flow exits from the aroma container through the at least one air outlet opening. The aroma container comprises an aroma chamber containing a carrier substance for an aroma substance. The carrier substance preferably has a specific flow resistance of less than 500 Pa·s/m, particularly preferably of less than 400 Pa·s/m, and most preferably of approximately 380 Pa·s/m.

As soon as there is a negative pressure during the drinking process either at the mouthpiece or at the drinking end of the drinking straw, there is also sufficient negative pressure at the end of the aroma channel as well as at the outlet of the aroma container so as to let air flow through the aroma container.

The drinking device according to the invention can thus be designed in a variety of ways. The aroma container can be arranged at the drinking straw in such a way that the aromatized air flow exiting from the at least one air outlet opening of the aroma container enters into the inner flow channel of the drinking straw through the at least one aroma inlet opening, and the user can ingest the drinking liquid provided with the aromatized air flow either directly at the drinking end of the drinking straw or via an additional mouthpiece attached at the drinking end. Alternatively, a user can ingest the drinking liquid through the inner flow channel of the drinking straw and the aromatized air flow via an aroma channel provided separately from the inner flow channel. In this regard, the aroma channel can be provided at the drinking straw separately from the inner flow channel or be connected with the aroma container. In the latter case, the drinking straw can be a conventional drinking straw which does not have to have an aroma inlet opening into the inner flow channel. Another alternative is that the aroma container and a mouthpiece arranged at the drinking end of the drinking straw are jointly configured. In this case, the aromatized air flow runs neither in the inner flow channel of the drinking straw nor in parallel thereto, but is either fed into the drinking liquid downstream in the region of the mouthpiece or runs in parallel to the flow chamber for the drinking liquid in the mouthpiece.

It is essential that the aroma container comprises an aroma chamber containing a carrier substance for the aroma substance which is released to the air when air flows through the aroma container.

The carrier substance preferably has a specific flow resistance of less than 500 Pa·s/m, particularly preferably of less than 400 Pa·s/m, and most preferably of approximately 380 Pa·s/m. In this case, in accordance with the conventional definition, the ratio of the pressure difference before and after a material layer to the speed of the air flowing through is referred to as the specific flow resistance. The flow resistance is measured according to DIN EN ISO 9053-1 on a test specimen of the carrier material. The flow velocity of air is determined as a function of the pressure difference across the test specimen. In numerous tests, the preferred flow resistance has turned out to be particularly suitable for causing a good flow through the carrier substance in the aroma chamber of the aroma container, but also enabling a good enrichment of the air flow flowing through the aroma container and an improved aroma development when using the aroma container with a drinking straw.

All of the variants described above have in common that the aromatized air flow is not released to the ambient air, in order to act orthonasally in a user, but is rather orally ingested by the user during drinking so that the aromatized air can be perceived retronasally and the sensory impression of a taste perception of the drinking liquid can be created.

According to a preferred embodiment of the invention, the aroma container can be moved relative to the drinking straw, preferably along a longitudinal direction of the drinking straw, between an activated position and a non-activated position, wherein only in the activated position the at least one air outlet opening is in flow connection with the at least one aroma inlet opening and the aroma channel.

The movement of the aroma container between the non-activated position and the activated position extends the service life of the aroma container since there is no unintentional evaporation when it is not in operation. The movement of the aroma container between the non-activated position and the activated position can be performed by the user themselves so that the drinking device according to the invention can also be used to hold non-aromatized drinking liquid.

In the simplest case, the movement of the aroma container, which is preferably in a longitudinal direction of the drinking straw, can establish or interrupt a flow connection between the air outlet opening of the aroma container and the aroma inlet opening of the drinking straw or an inlet opening into the aroma channel of the drinking straw.

Preferably, the aroma container comprises the mouthpiece. In this case, the aroma container is mounted at the drinking end of the drinking straw and comprises the mouthpiece for the user who can thus orally ingest drinking liquid provided with an aromatized air flow or, by means of two separate transport channels ending at the mouth end of the mouthpiece, can orally ingest pure drinking liquid and aromatized air simultaneously.

The provision of an aroma container with a mouthpiece has the advantage that, when the aroma container is replaced, a user can intuitively reassemble the drinking device correctly. When providing separate flow channels for the drinking liquid and the aromatized air flow, it is moreover possible to use a conventional drinking straw in the drinking device.

According to a first alternative, preferred embodiment, the drinking straw has an aroma channel provided separately from the flow channel and ending at the drinking end of the drinking straw. Alternatively, however, the aroma container can also comprise the aroma channel. It is particularly preferable, however, in the case of separately providing a flow channel for drinking liquid and a transport channel for the aromatized air flow, to configure the aroma channel between a first boundary wall surrounding the inner flow channel of the drinking straw and a second boundary wall formed by the aroma container. In this way, the configuration of the drinking device with separate flow channels can be realized with minimal use of material.

According to a preferred embodiment of the invention, the drinking device further comprises a sealing member which extends around the drinking straw and is suited to be mountable on drinking vessels with different diameters.

The configuration of the drinking device with a sealing member makes it particularly suited to be transported without the drinking liquid in the drinking vessel sloshing out. The provision of a sealing member suited to be mountable on drinking vessels with different diameters increases the variability of the drinking device since the user can use it with different drinking vessels.

In this regard, it has turned out to be a particularly suitable configuration to design the sealing member in such a way that it is a continuously conical or stepped conical, rotationally symmetrical member. In this way, irrespective of the opening diameter at the upper end of the drinking vessel, the sealing member can be placed onto the drinking vessel in a sealing manner as long as the drinking vessel has a round opening and the diameter of the round opening lies within the range of diameter of the rotationally symmetrical component of the sealing member. A continuously conical component can be placed onto any opening diameter, whereas in the case of a stepped conical component an annular step in the region of the stepped conical component rests on the upper edge of the drinking vessel.

According to an alternative embodiment, the sealing member can be an elastic sealing grommet. Such sealing grommets, for example made of a silicone material, are known for tightly sealing vessels of various sizes. The elastic sealing grommet is stretched over the upper edge of the drinking vessel and lies elastically against the side wall or side walls of the drinking vessel in the region of the upper edge. While the provision of the above-described continuously conical or stepped conical, rotationally symmetrical member is only suitable for drinking vessels with a circular opening cross-sectional shape, in the case of providing the sealing member in the form of an elastic sealing grommet a drinking vessel with other cross-sectional shapes, for example a square cross-sectional shape, can be closed at the top in the same way.

According to a preferred embodiment of the invention, the drinking straw can be divided in the longitudinal direction. This configuration has the advantage that the drinking straw can be easily cleaned by dividing it into two U-shaped portions that can be cleaned separately, for example under running water.

According to an alternative, preferred embodiment, the drinking straw has a film hinge extending in the longitudinal direction and can be opened in the longitudinal direction. This measure also serves to simplify cleaning of the drinking straw by allowing it to be opened, making the inner walls of the drinking straw easily accessible.

Preferably, the drinking straw has a plurality of predetermined bending points. In this way, irrespective of the geometry of a drinking vessel, a drinking straw with a standardized length can be used. Another advantage is that the drinking device according to the invention can be transported more safely since unintentional pressure on the drinking straw, for example in a bag during transport, does not result in damage to the drinking straw, since the bending points allow the drinking straw to avoid the action of a force or to adapt to a non-flat contact surface. Furthermore, the drinking straw with predetermined bending points can be transported in a particularly space-saving manner.

Alternatively, it is also possible according to a further preferred embodiment to configure the drinking straw so as to be elastically deformable. Thus, no predetermined bending points are provided at defined positions, but the drinking straw has sufficient overall elastic deformability so that the risk of unintentional damage, for example kinking of the drinking straw, can be avoided to the furthest extent.

According to a preferred embodiment of the invention, the drinking device according to the invention further comprises a weight provided at the end opposite in the longitudinal direction to the drinking end of the drinking straw, which has a bearing surface for resting on the inner bottom of a drinking vessel.

The provision of a weight has the advantage that the drinking straw is always kept at the bottom of the drinking vessel. In the case of a rigid drinking straw, this can also prevent the drinking device from tipping over in the drinking vessel.

According to a further preferred embodiment of the invention, the drinking straw has a receptacle for the aroma container, into which the aroma container can be inserted. In other words, an adapter is already fixedly provided on the drinking straw, into which the aroma container can be inserted. In this way, firstly, the aroma container can be activated by exposing the air outlet opening only when it is placed in the receptacle and, secondly, it can also be ensured by the geometry of the receptacle and the complementary geometry of the aroma container that the aroma container is connected in the correct functional arrangement relative to the drinking straw.

Preferably, the drinking straw comprises a first longitudinal portion and a second longitudinal portion, wherein the aroma container can be attached between the first longitudinal portion and the second longitudinal portion of the drinking straw. Thus, the aroma container constitutes a coupling member between the first longitudinal portion and the second longitudinal portion of the drinking straw. This configuration is easy to understand for a user so that, when replacing the aroma container when it is empty or a different flavor is desired, the aroma container can be exchanged in a very simple way. The coupling geometry between the drinking straw and the aroma container can also be used to activate the aroma container.

In this regard, it can be advantageous to configure the aroma container in such a way that the receiving area for the drinking straw is designed conically so that drinking straws with different outer diameters can be used together with an aroma container.

According to a further preferred embodiment of the invention, the aroma container is mounted on the drinking straw, preferably clipped on, wherein the aroma container comprises a penetration member suited to penetrate the drinking straw when mounting the aroma container on a drinking straw and to create the aroma inlet opening. In this way, the aroma container can be used with a conventional drinking straw since the drinking straw does not yet have to have a prefabricated aroma inlet opening before mounting the aroma container. Another advantage is that due to the creation of the aroma inlet opening when mounting the aroma container exact positioning of the aroma container is not necessary. The penetration member has the further function of fixing the position of the aroma container on the drinking straw.

Preferably, the inner flow channel of the drinking straw in some areas has a reduction of the cross-section in the region of the aroma inlet opening. A reduction of the cross-section in the flow channel of the drinking straw creates a Venturi effect. In the area of the narrowing of the flow, the dynamic pressure is maximal, whereas the hydrostatic pressure is minimal. Moreover, the flow speed of the drinking liquid during drinking is increased in the area of the narrowing. The narrowing thus has the effect of lowering the pressure in the inner flow channel in the area of the reduction in cross-section, creating a suction effect with the aid of which the aromatized air is drawn from the aroma container.

The invention further relates to a drinking vessel comprising a bottom and at least one side wall extending from the bottom upwards and limiting a volume for receiving drinking liquid as well as a drinking device according to the invention.

Preferably, the drinking vessel is configured is such a way that the drinking straw of the drinking device is fixedly connected with a side wall of the drinking vessel, wherein the side wall of the drinking vessel preferably directly limits the inner flow channel. In this way, the drinking device according to the invention can be fixedly integrated into a drinking vessel.

Depending on the case of use, the aroma chamber can also have at least one air inlet opening in addition to the air outlet opening. This configuration is only avoided if, when the drinking device is used as intended in a drinking vessel, the aroma container is in the drinking liquid. However, if the aroma container is located in the area of the drinking end of the drinking device or if the aroma container is provided with a mouthpiece, an air inlet opening makes air flow through the aroma container easier and also enables better enrichment of the air flow with the aroma substance.

In those embodiments without an air inlet opening into the aroma container, the pressure is equalized by the ambient air flowing back into the aroma container through the air outlet opening as soon as the air outlet opening is not closed by surrounding liquid. If the aroma container is arranged at the drinking straw in such a way that it is located within the drinking liquid in a drinking vessel, the drinking straw is also filled with drinking liquid at least up to the height of the liquid in the drinking vessel. In this way, the air outlet opening of the aroma container can be closed since no aromatized air can get out and, at the same time, due to the small size of the air outlet opening and the associated capillary effect, no liquid gets into the interior of the aroma container. In this way, the drinking device can remain in the drinking vessel filled with liquid during use without undesired loss of aroma substance since aromatized air exits from the air outlet opening of the aroma container only during drinking.

Preferably, apart from the carrier substance, a head space is also provided in the aroma chamber between the carrier substance and a wall of the aroma container that closes off the aroma chamber. Providing a head space improves the mixing of the aromatized air in the aroma container. The aroma substance can consist of numerous chemical compounds, the mass transfer behavior of which differs from the carrier substance into the head space of the aroma container. Both different transport speeds of different chemical substances may occur and different aromatization compositions may exist within the aroma chamber that can be homogenized within the head space.

Preferably, a nonwoven fabric is provided as a carrier substance, which has high air permeability that is not supposed to lie below 200 $l/(m^2 \cdot s)$. At the same time, air permeability of the nonwoven fabric at a differential pressure of 100 Pa should preferably not be higher than 500 $l/(m^2 \cdot s)$. The reason for this is that, if the air permeability is too high, there is the risk that preferred flow paths are formed within the nonwoven fabric so that the air flow exiting from the aroma container would already have a too low degree of aromatization long before the aroma substance has in fact been exhausted. Moreover, the most suitable geometry of the carrier substance as well as the size of the head space may vary depending on the individual aroma substances. Different aroma substances have different chemical structures influencing their behavior with regard to mass transfer and flow properties so that a separate optimization process can be carried out for each individual flavor in order to achieve an optimal taste experience.

Preferably, the thickness of the carrier substance with regard to the height of the aroma chamber is at least 50% and preferably at least 80% of the height between a lower wall of the aroma container and an upper wall.

Preferably, the aroma container has an essentially annular geometry so that the aroma container can be arranged around the drinking straw, resulting in a weight distribution that is perceived as particularly comfortable by a user. In this regard, the geometry of the aroma container may deviate from an exact circular shape, however, to interact with a complementarily shaped drinking straw in such a way that only a single radial orientation of the aroma container relative to the drinking straw is possible, allowing the exact radial position of the aroma container to be defined relative to the drinking straw.

BRIEF DESCRIPTION OF THE FIGURES

In the following figures, the invention will be described, purely by way of example, by means of different embodiments. The figures show the following:

FIG. 6 and FIG. 6*a* a further embodiment of the drinking device according to the invention as well as a detailed view;

DESCRIPTION OF PREFERRED EMBODIMENTS

In the following exemplary embodiments, the same elements will be designated with the same reference numbers.

Figure 1A:
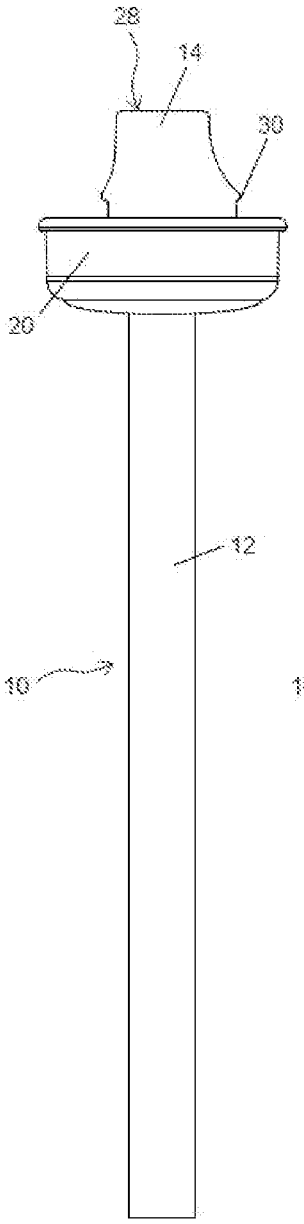
FIG. 1*a* and FIG. 1*b* a drinking device according to the invention in the activated and non-activated state.
Figure 1B:
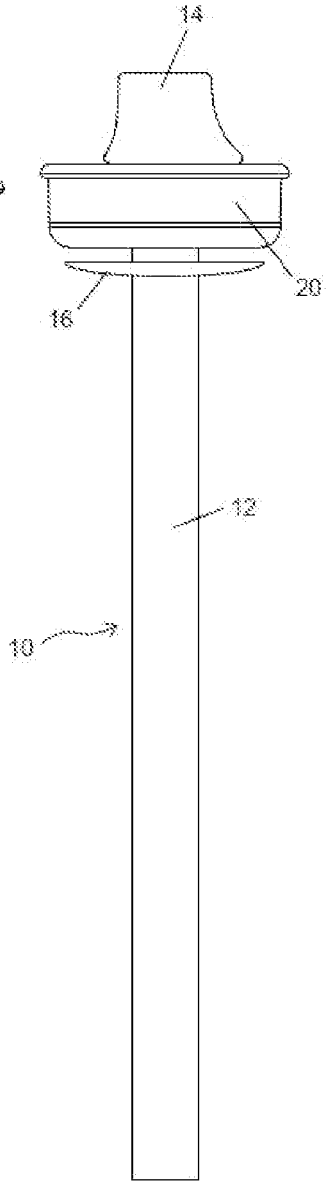
Figure 2:
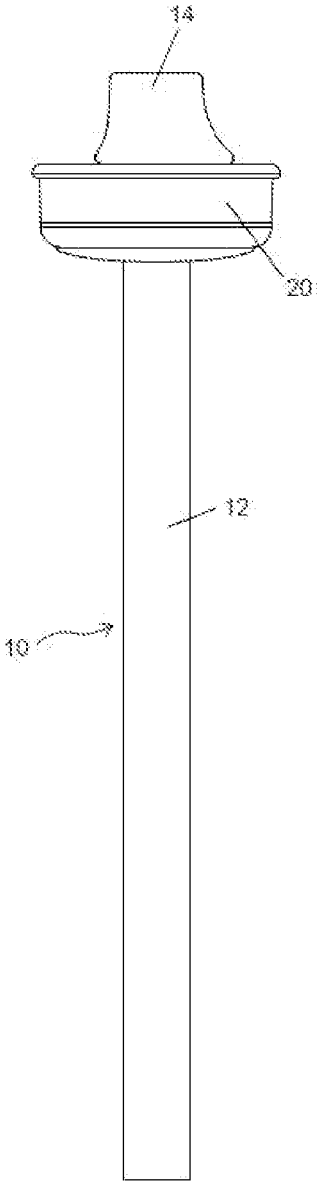
FIG. 2 a drinking device in which the aroma container cannot be deactivated.

With regard to FIGS. 1*a*, 1*b* and 2, a basic structure of the drinking device 10 according to the invention is described. The drinking device 10 consists of a drinking straw 12, an aroma container 20 as well as an optional mouthpiece 14 which can also be present in the following embodiments, wherever this is expedient. The mouthpiece 14 defines the drinking end for the user. The drinking straw 12 is inserted into a drinking liquid in a conventional manner and, by sucking at the mouthpiece 14, sucked through an inner flow channel through the drinking straw 12 upwards in the direction of the mouthpiece 14 and therethrough.

The drinking device further comprises an aroma container 20 comprising, as will be described later by means of FIG. 5*c*, an aroma chamber containing a carrier substance for an aroma substance or a mixture of various aroma substances. During the drinking process, the aroma container 20 releases air aromatized with the aroma substance that is, as will be explained below by means of several examples, either introduced into the inner flow channel of the drinking straw 12 or conveyed in a separate aroma channel in the direction towards the mouthpiece 14. In the mouthpiece 14, the aromatized air can either flow back into the flow channel for liquid or be directed in a separate flow channel up to the mouth end 28 of the mouthpiece 14.

However, if there are separate flow channels for the drinking liquid and for the aromatized air, it is important that the mouthpiece 14 is configured in such a way that both the drinking liquid and the aromatized air are orally ingested during the drinking process.

In the example illustrated in FIG. 2, the aroma container is fixedly connected with the drinking device 10 and is always in an activated state in which aromatized air can be released from the aroma container.

To extend the service life of the drinking device 10 according to the invention, it can be expedient if the drinking device is configured in such a way that the aroma container 20 can be moved between an activated and a non-activated position. To this end, the aroma container 20, which extends essentially annularly around the drinking straw 12 in the embodiment example according to FIGS. 1 and 1*b*, can either be moved by a rotational motion between an activated position and a non-activated position or, as illustrated in the specific embodiment example according to FIGS. 1*a* and 1*b*, be shifted in the longitudinal direction by shifting the drinking straw 12 in a longitudinal direction between the non-activated position illustrated in FIG. 1*a* and the activated position illustrated in FIG. 1*b*. Only in the activated position does an air outlet opening provided in the aroma container align with an aroma inlet opening either in the inner flow channel of the drinking straw 12 or in a separate aroma channel, while in the non-activated position the air outlet opening from the aroma container is closed.

To give a haptic feedback to the user with regard to the shifting movement between the activated and the non-activated position, a stop 16 is fixedly provided at the drinking straw 12, against which the aroma container is shifted when it is brought into the non-activated position. At the mouthpiece, a stop 30 is also provided which limits the shifting movement into the activated position. In this way, the user can activate the aroma container by shifting the aroma container between the two stop positions in a simple manner. Compared to the embodiment of the drinking device illustrated in FIG. 2 with an aroma container that is always in an activated state, the option of activating the aroma container does not only have the advantage of extended service life, but also the option of using the drinking device in the non-activated state, for example if it is desired to drink pure drinking liquid.

Figure 3A:
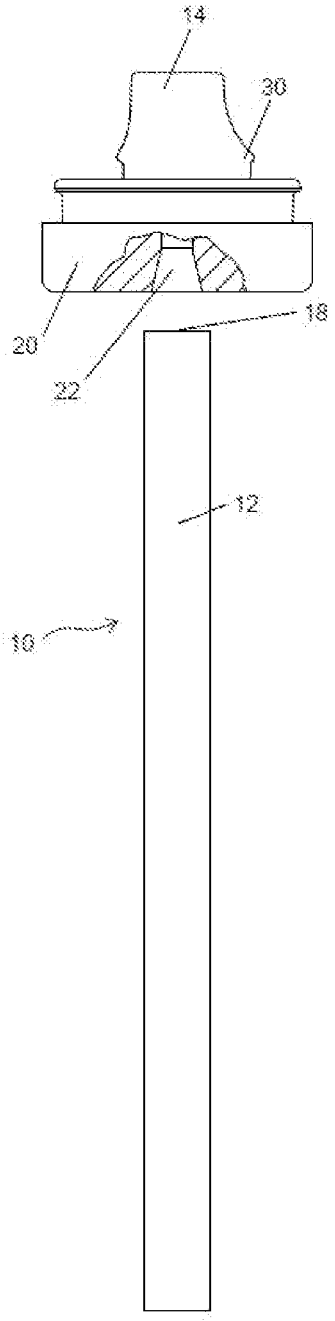
FIG. 3*a* a possible configuration of the receiving area for the drinking straw in the aroma container in an exploded view and a partial sectional view.
Figure 3B:
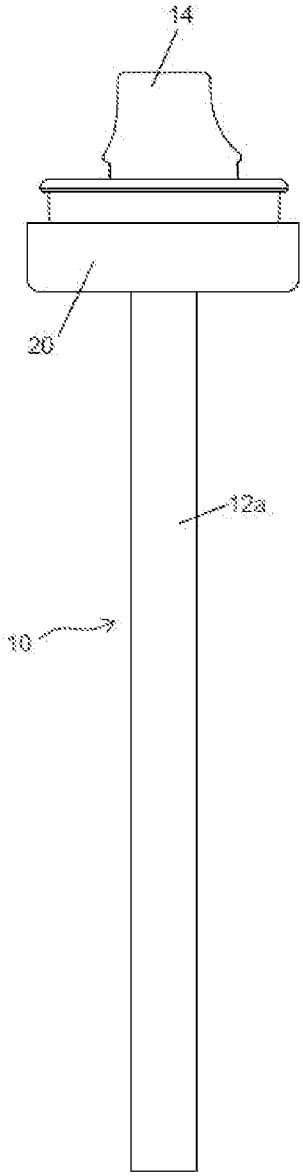
FIG. 3*b* and FIG. 3*c* the use of the drinking device according to FIG. 3*a* with drinking straws having different diameters.
Figure 3C:
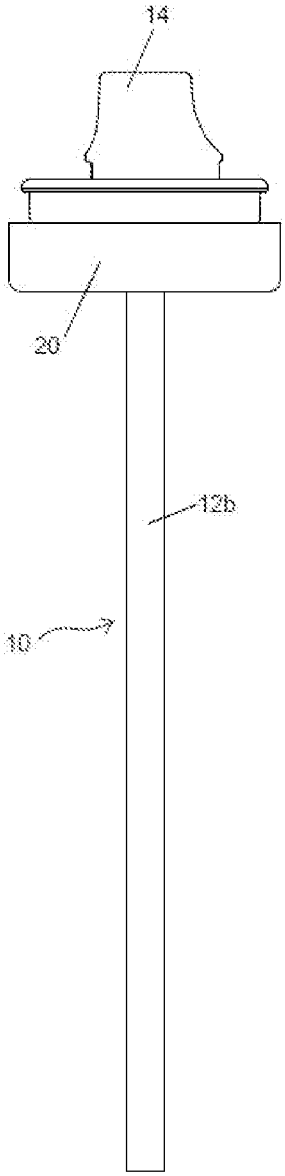

In FIGS. 3*a*, 3*b* and 3*c*, an alternative embodiment of the drinking device 10 is illustrated which consists, in the present case, of an aroma container 20 with an integrated mouthpiece 14 into which a conventional drinking straw 12 can be inserted.

Furthermore, it is preferred if a conical receiving area 22 is provided in the aroma container, which serves for receiving the drinking end 18 of the drinking straw 12. Due to the conical receiving area 22, the aroma container according to FIG. 3*a* can be used with drinking straws 12*a*, 12*b* with different diameters, as illustrated in FIGS. 3*b* and 3*c*.

In the configuration of the drinking device 10 according to FIG. 3*a*, a conventional drinking straw 12 can be used since the aromatized air from the aroma container 20 is supplied in the area of the mouthpiece 14 and thus no drinking straw 12 with a defined and specifically arranged aroma inlet opening into the inner flow channel of the drinking straw has to be used.

Figure 4A:
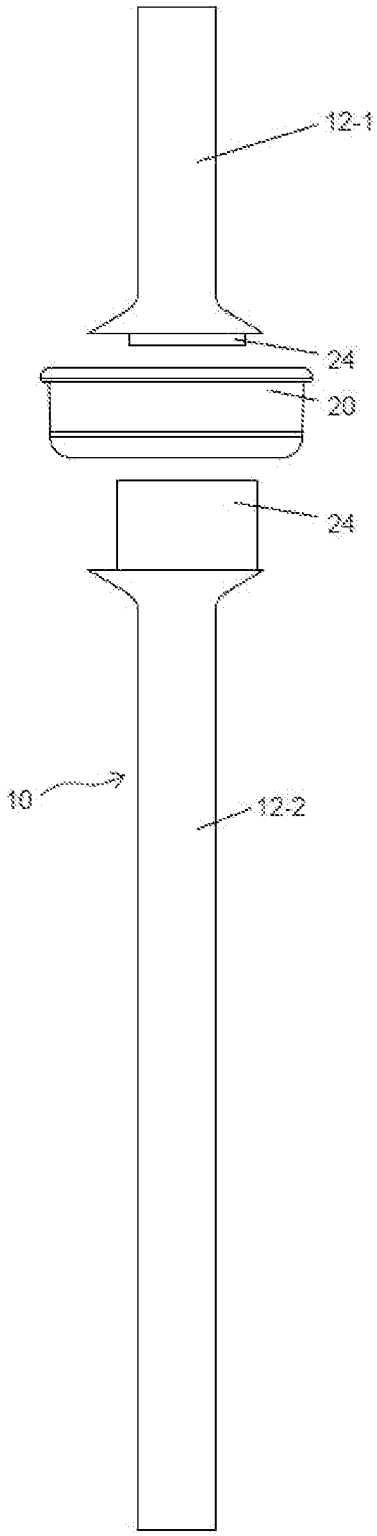
FIG. 4*a* and FIG. 4*b* an exploded view as well as a view in the assembled state of a further embodiment of the drinking device according to the invention.
Figure 4B:
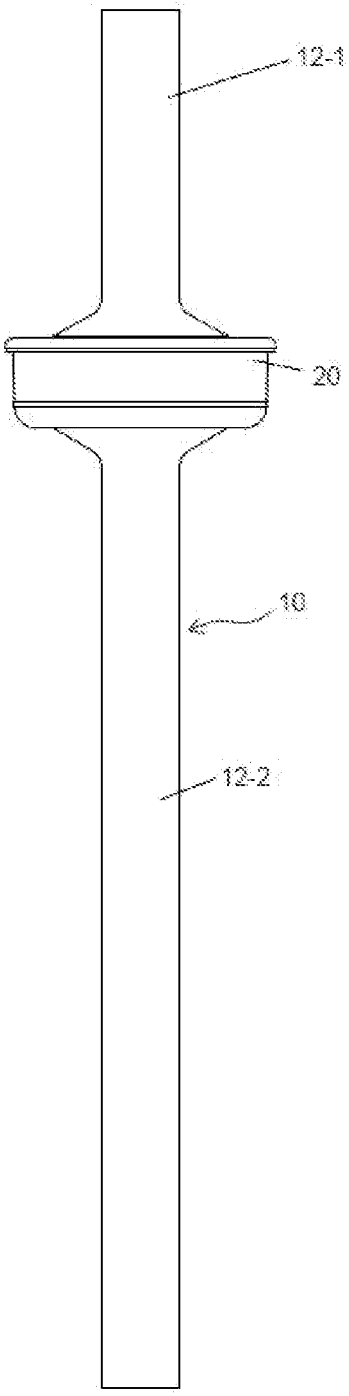

In FIGS. 4*a* and 4*b*, a further alternative embodiment of the drinking device 10 according to the invention is illustrated. In this regard, the aroma container 20 is located between the partial portions 12-1 and 12-2 of the drinking straw. The embodiment according to FIGS. 4*a* and 4*b* is advantageous since exchanging the aroma container 20 is very simple and can be performed intuitively by a user. To this end, the aroma container 20 preferably deviates from a circular ring-shaped geometry. Since at least the inner opening of the aroma container does not have a circular geometry, the two portions 12-1 and 12-2 of the drinking straw, each of which are provided with coupling elements 24, can only be inserted in a defined orientation relative to the aroma container 20. The two coupling elements 24 can be configured in such a way that they not only extend through the inner opening in the annular aroma container 20, but can also be inserted into each other in a fluid-tight manner so as to provide a flow-tight connection between the partial portions 12-1 and 12-2 of the drinking straw, while at the same time also providing the correct orientation relative to the aroma container 20 and the air outlet opening from the aroma container is exactly aligned relative to an aroma inlet opening into one of the coupling elements 24.

The embodiment according to FIGS. 4*a* and 4*b* has the advantage that not only an aroma container 20 can be easily replaced with another aroma container, but the drinking straw can also be cleaned. Of course, it is also possible in the embodiment according to FIGS. 4*a* and 4*b* to couple the drinking end of the drinking straw 12-1 with a mouthpiece.

Figure 5A:
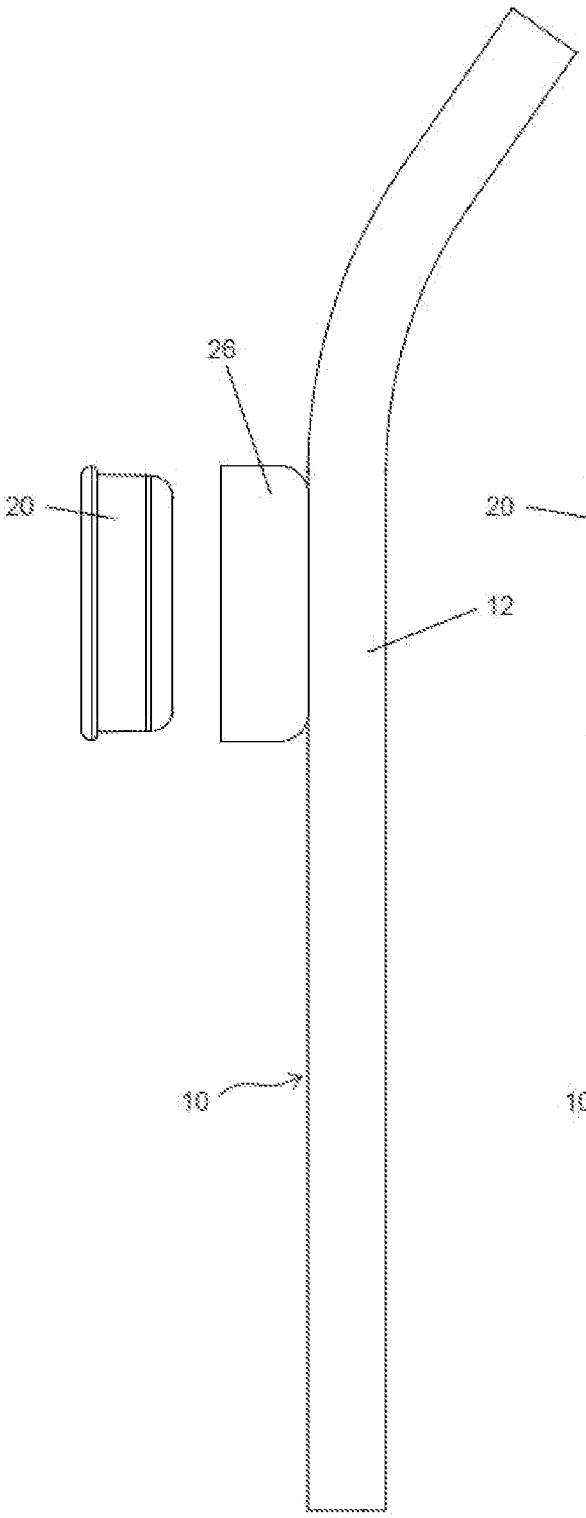
FIG. 5*a* and FIG. 5*b* a further embodiment of the drinking device according to the invention in an exploded view and in the assembled state.
Figure 5B:
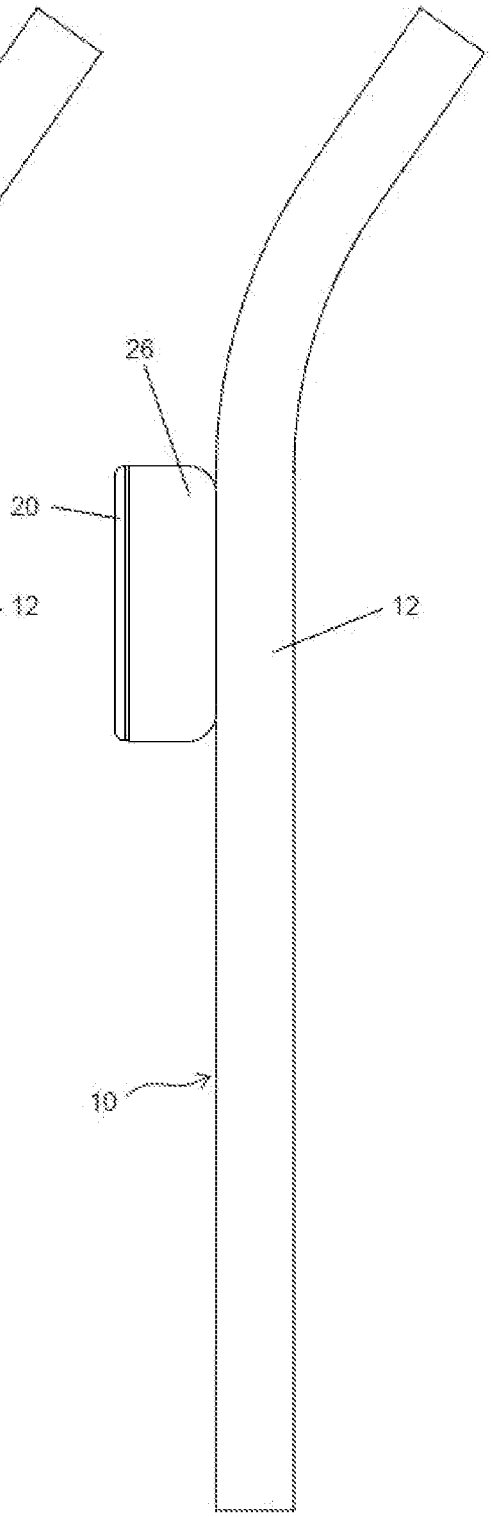
Figure 5C:
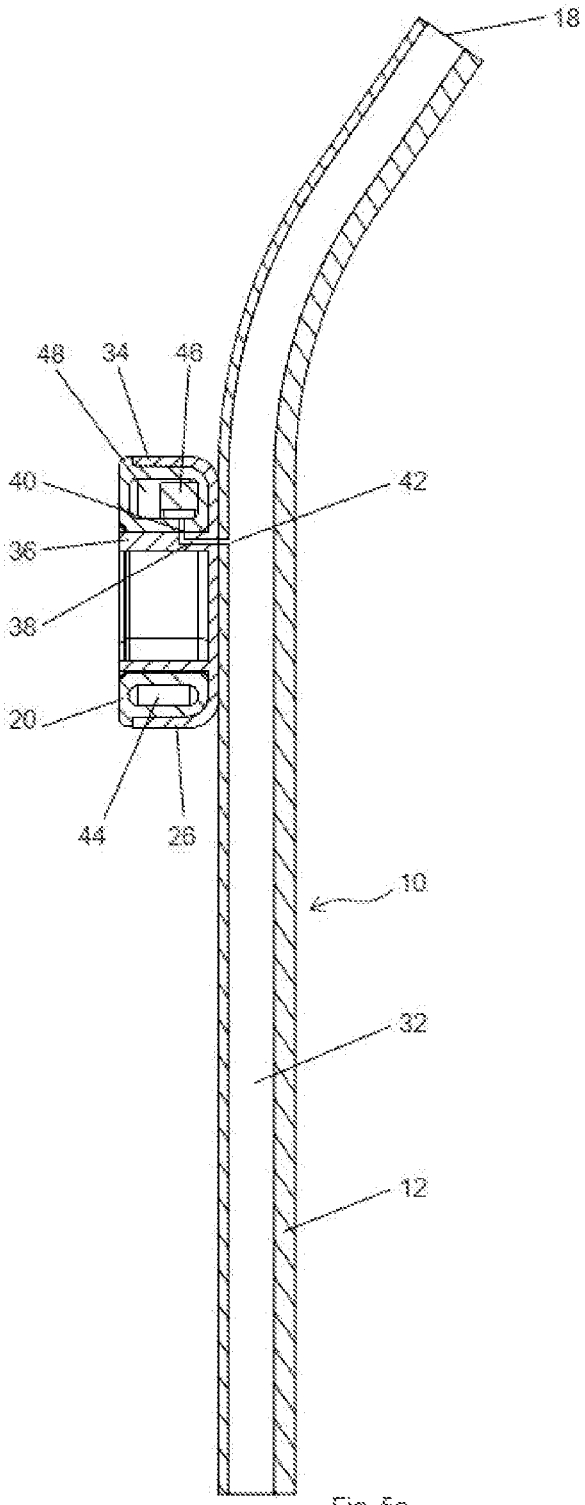
FIG. 5*c* a sectional view of the drinking device according to FIG. 5*b;*

In the embodiment according to FIGS. 5*a*, 5*b* and 5*c*, the aroma container 20 does not extend around the drinking straw 12, but is inserted into a receptacle 26 at the drinking straw 12, thus putting the drinking device 10 in the operating state. To this end, the aroma container 20 illustrated in FIG. A is inserted into the receptacle 26 in the direction of the arrow A, resulting in the ready-to-use drinking device according to FIG. 5*b*.

By a suitable complementary shaping of the receptacle 26 and the geometry of the aroma container 20, it can be ensured that the aroma container is exactly positioned so as to be able to release the aromatized air.

The aroma container 20 can be mounted in the receptacle 26 by clamping, using a suction cup in the receptacle or by any other method. For example, the aroma container can be pinned, screwed fast or mounted by means of a bayonet lock. Moreover, other aids can be used such as magnets, a Velcro strip or even a rubber band.

In FIG. 5*c*, a possible configuration of the drinking device 10 according to FIG. 5*b* is illustrated. In this regard, the drinking straw 12 has an inner flow channel 32 through which, just like in a conventional drinking straw, the drinking liquid is sucked by the user in the direction towards the drinking end 18 of the drinking straw 12. In addition to the bowl-shaped outer wall 34 illustrated in FIGS. 5*a* and 5*b*, the receptacle 26 for the aroma container 20 also has an inner wall 36 in which an aroma channel 38 is located that is in flow connection with the air outlet opening 40 in the aroma container and is furthermore in flow connection with the aroma inlet opening 42 at the drinking straw 12, which opens into the inner flow channel 32 of the drinking straw 12.

As further illustrated in FIG. 5*c*, an aroma chamber 44 is located inside the aroma container, which contains a carrier substance 46 that does not completely fill the aroma chamber 44.

In this regard, in the illustrated annular geometry of the aroma container 20, the carrier substance 46 cannot fully extend around the annular aroma chamber 44, but can be configured in a U-shape, for example, which facilitates the automatic insertion of the carrier substance into the aroma chamber when producing the aroma chamber. Since the carrier substance 46 does not completely fill the aroma chamber 44, an air-filled head space 48 is formed within the aroma chamber 44, in which the aroma substance consisting of various chemical compounds can be mixed and homogenized.

The geometry of the aroma container illustrated in FIG. 5*c* does not have a circular ring shape so that the aroma container can only be inserted in a defined position relative to the receptacle 26, in which the flow connection between the aroma container and the inner flow channel 32 of the drinking straw 12 exists.

The carrier substance has a specific flow resistance of less than 500 Pa·s/m and preferably of less than 400 Pa·s/m, and most preferably of approximately 380 Pa·s/m so as to feed a sufficient amount of aromatized air into the inner flow channel 32 of the drinking straw 12 during the conventional use of the drinking straw 12 by the user.

Figures 5A, 6:
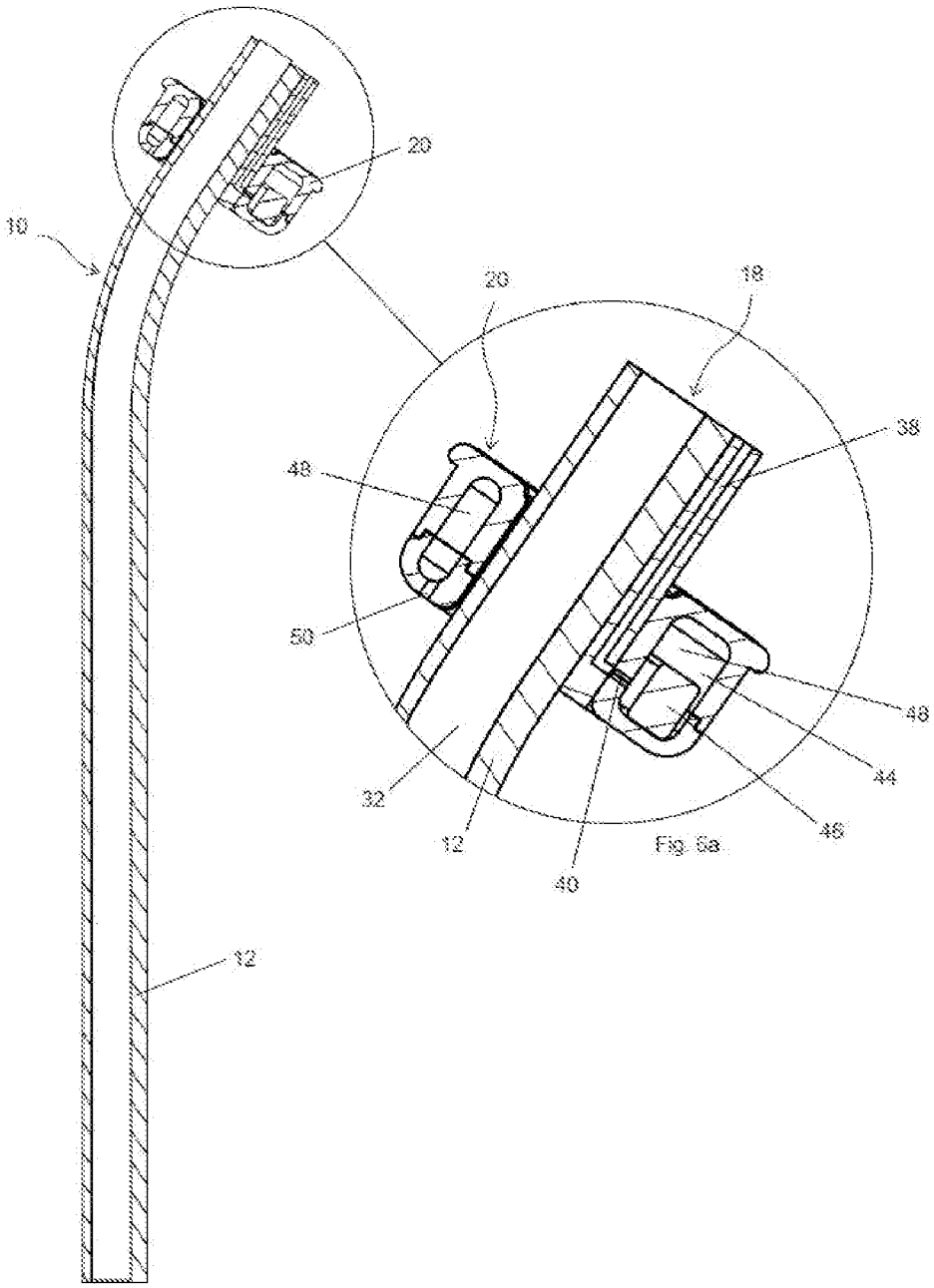

The embodiment according to FIGS. 6 and 6*a*, which illustrates in an enlarged view the area at the drinking end of the drinking straw according to FIG. 6, is an alternative configuration of the drinking device according to the invention, in which, in contrast to what was illustrated in the sectional view in FIG. 5*c*, the aroma channel 38 does not open via an aroma inlet opening into the inner flow channel 32 of the drinking straw, but is led in parallel thereto to the drinking end 18 of the drinking straw 12. To this end, in parallel to the inner flow channel 32, an aroma channel 38 is provided through which the aromatized air is sucked during the drinking process and is orally ingested.

Furthermore, an air inlet opening 50 is illustrated in FIG. 6*a*, through which air enters into the aroma container 20. In the general, annular configuration of the aroma container 20, the air inlet opening 50 is arranged opposite to the air outlet opening 40 so as to ensure that the air flowing through the aroma container has to travel a sufficient distance before it leaves the aroma container again through the air outlet opening 40 in a sufficiently aromatized state.

Figure 7A:
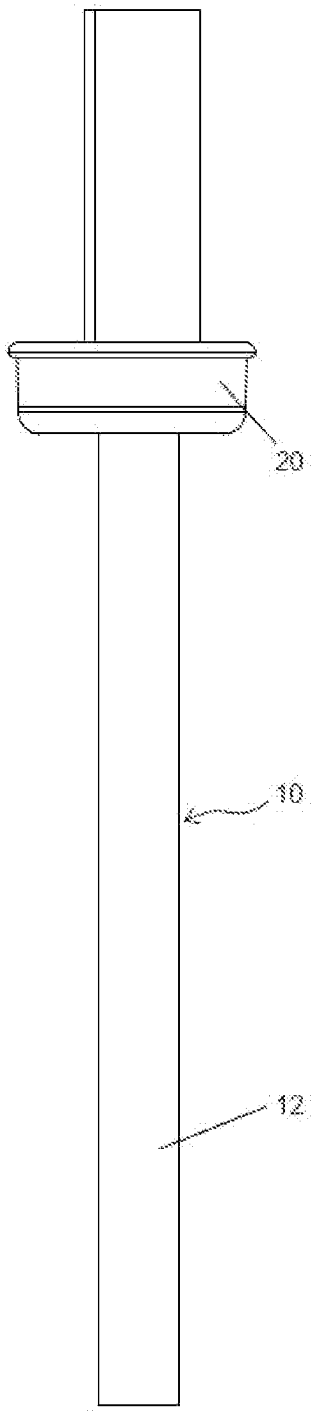
FIG. 7*a* and FIG. 7*b* an exterior view and sectional view of a further embodiment of the drinking device according to the invention.
Figure 7B:
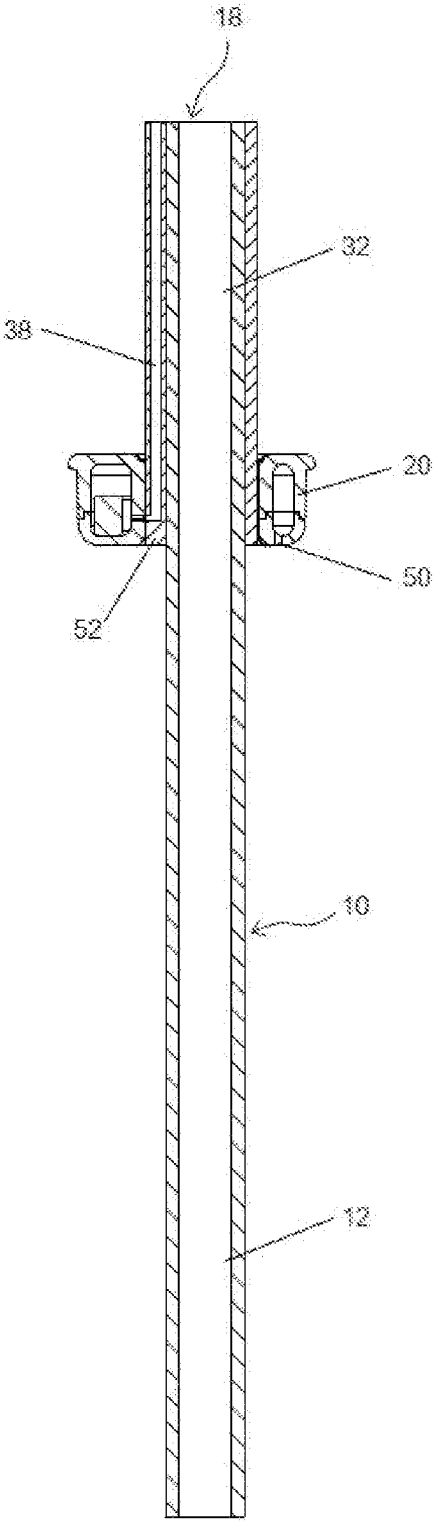

The embodiment according to FIGS. 7*a* and 7*b* is essentially identical with the embodiment according to FIGS. 6*a* and 6*a*. However, in the configuration according to FIGS. 7*a* and 7*b*, the aroma channel 38 is part of the aroma container 20 that is slid onto the drinking straw 12 until it abuts against the stop 52 provided fixedly at the drinking straw, which ensures that the aroma channel 38 of the aroma container ends at the drinking end 18 of the drinking straw 12.

The design according to FIG. 7*b* results in a double wall in the area between the inner flow channel 32 and the aroma channel 38. However, this double wall can also be removed, as illustrated in the embodiment according to FIGS. 8 and 8*a*. In the embodiment according to FIG. 8, the aroma container 20 is also slid onto the drinking straw 12. In this embodiment, the aroma channel 38 is formed between the wall 54 surrounding the inner flow channel 32 of the drinking straw 12 and the wall 56 of the aroma container 20.

Figure 8:
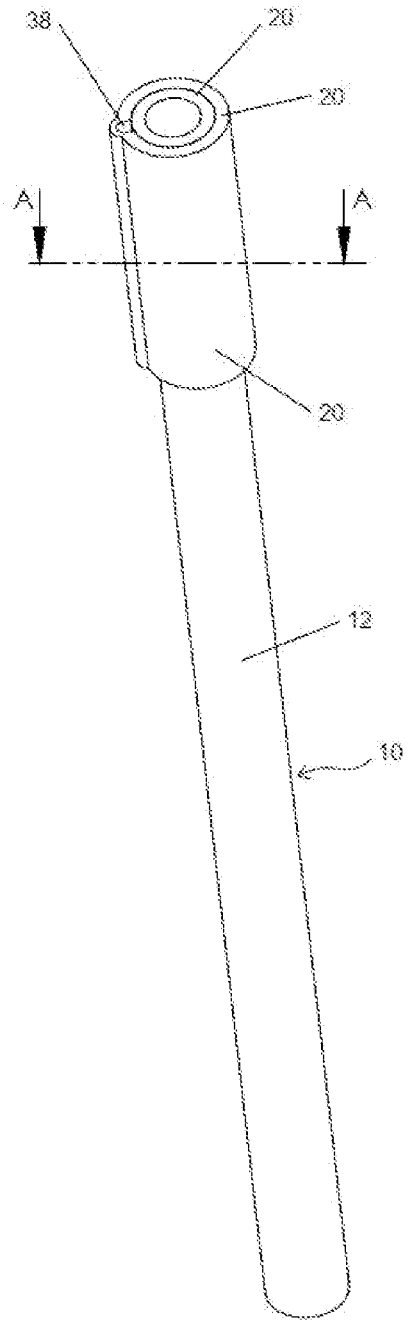
FIG. 8 and FIG. 8*a* an exterior view and a sectional view along the sectional plane A-A of a further embodiment of the drinking device according to the invention.
Figure 8A:
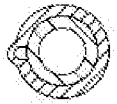

In the configuration according to FIG. 8, the aroma container can be designed to be very small and light, which does not only result in a better overall aesthetic impression, but also prevents the drinking straw from falling over in a drinking vessel or at least makes this more difficult.

In the embodiments according to FIGS. 9*a* to 16*c*, the aroma container or a possible mouthpiece are not shown since further properties of the drinking device according to the invention are to be illustrated here. Nevertheless, it should be clear that in all of these embodiments, an aroma container and optionally a mouthpiece are also provided.

Figure 9A:
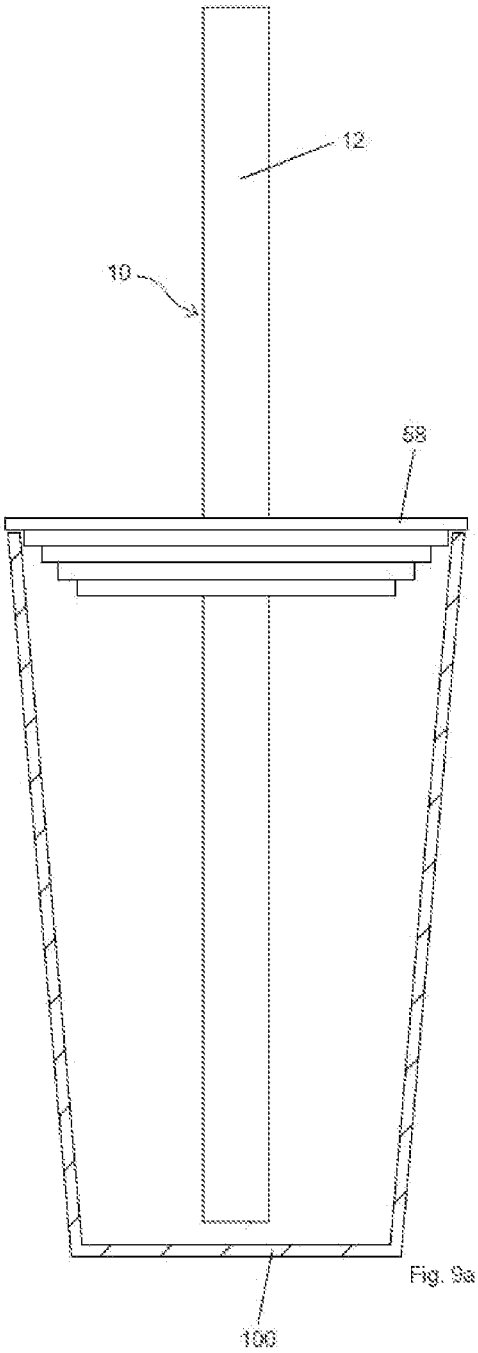
FIG. 9*a* and FIG. 9*b* a further embodiment of the drinking device according to the invention as well as a drinking vessel.
Figure 9B:
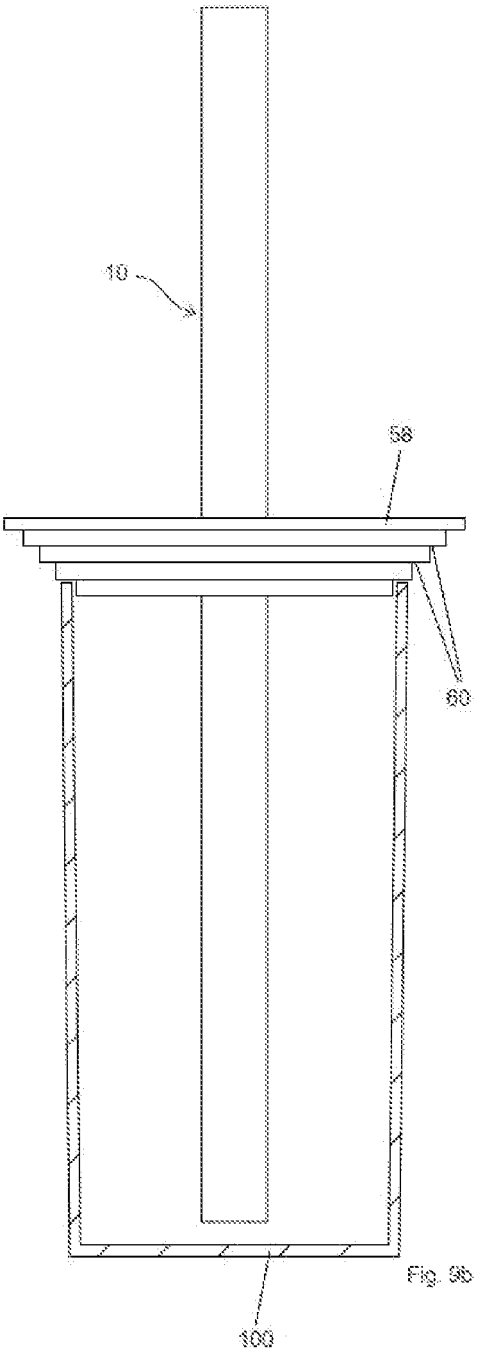

In the embodiment according to FIGS. 9*a* and 9*b*, the drinking device 10 according to the invention is illustrated in a drinking vessel 100. The drinking device 10 has a sealing member 58 which is fixedly connected with the drinking straw 12 and, in the configuration according to FIGS. 9*a* and 9*b*, consists of a rotationally symmetrical body having several steps 60 around its circumference. As illustrated by means of the examples in FIGS. 9*a* and 9*b*, the sealing member 58 can be put tightly on drinking vessels with different opening sizes since the stepped sealing member 58 is automatically centered on a drinking opening of the drinking vessel 100.

Figure 10A:
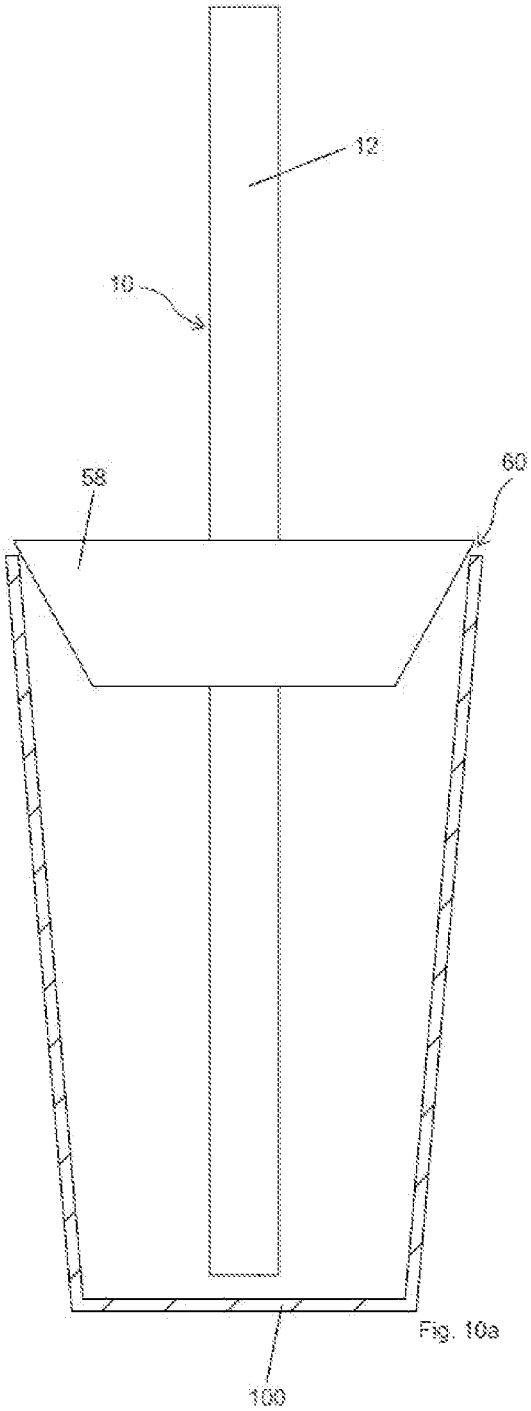
FIG. 10*a* and FIG. 10*b* a further embodiment of the drinking device according to the invention as well as a drinking vessel.
Figure 10B:
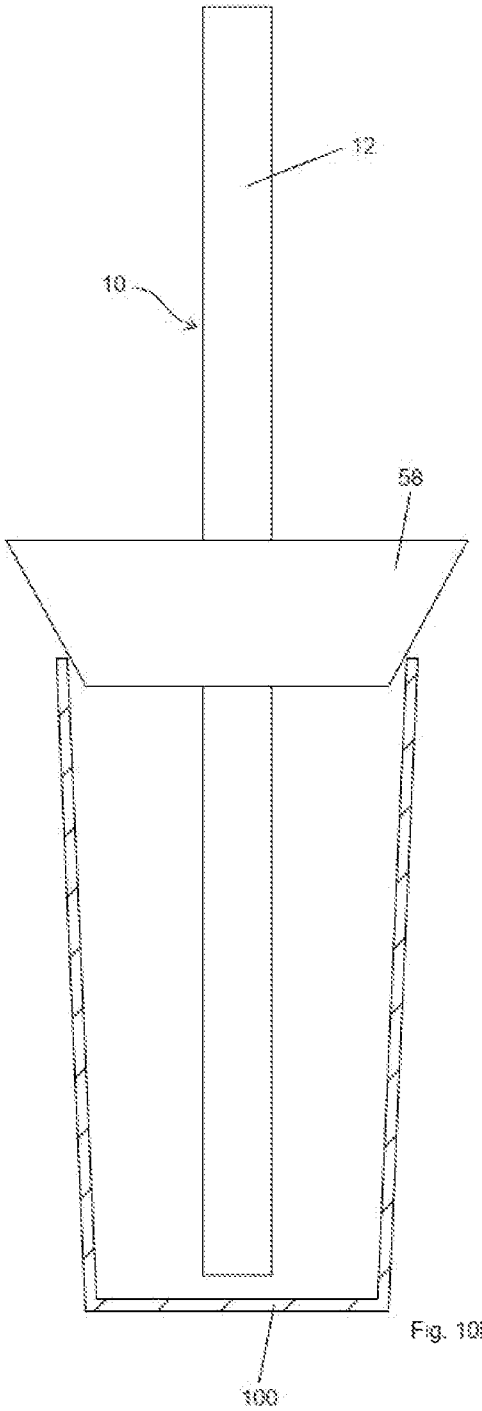

The embodiment according to FIGS. 10*a* and 10*b* differs from the embodiment according to FIGS. 9*a* and 9*b* merely in that the sealing member 58 has a conical geometry and can therefore also rest tightly on the drinking opening 60, irrespective of the size of the circular drinking opening of the drinking vessel 100.

Figures 11A, 11B, 11C:
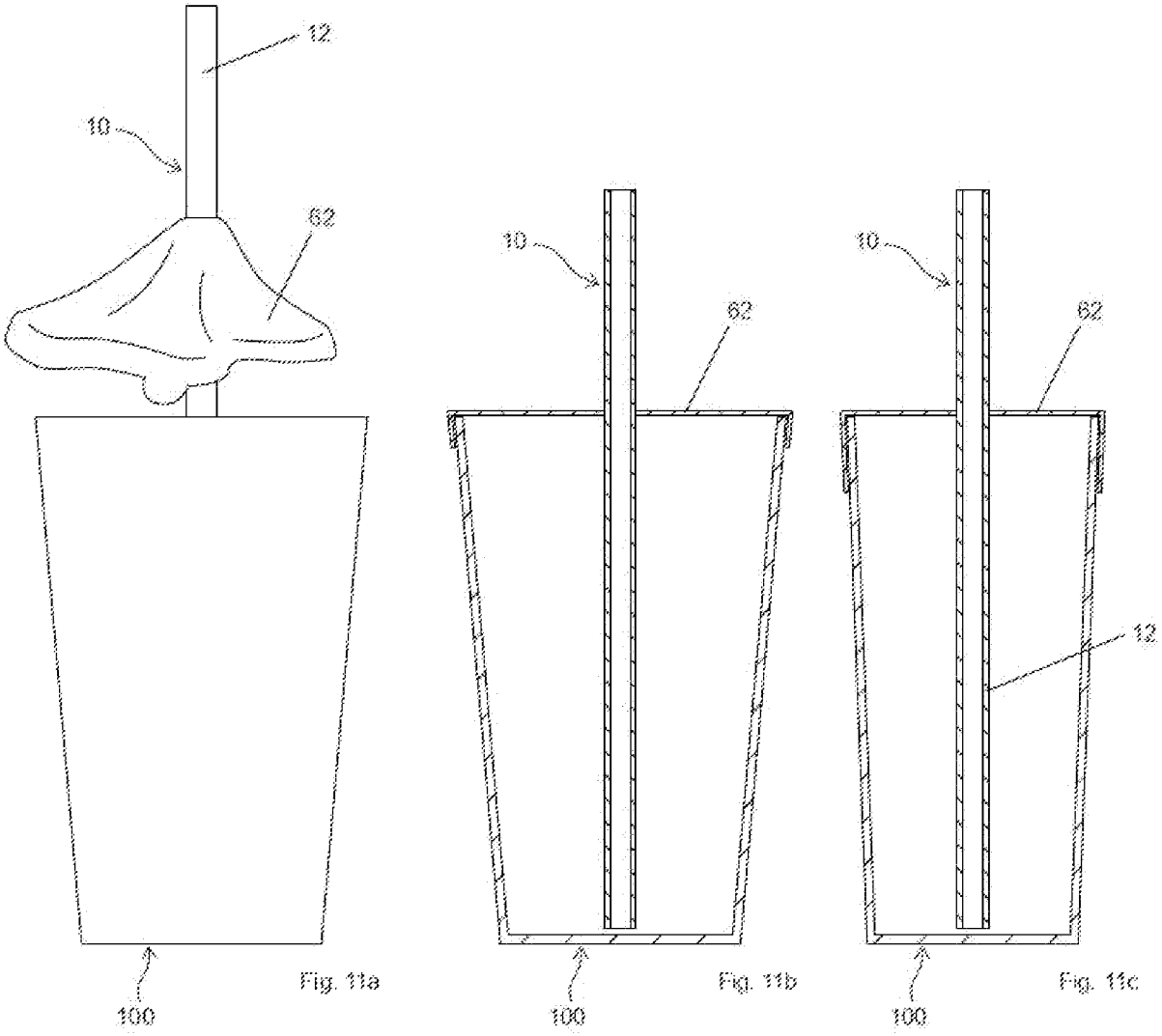
FIG. 11*a* FIG. 11*b* and FIG. 11*c* a further embodiment of the drinking device according to the invention as well as a drinking vessel.

The embodiments according to FIGS. 9*a*, 9*b*, 10*a* and 10*b* are suited in particular for drinking vessels with a circular geometry of the drinking opening 60. The embodiment illustrated in FIGS. 11*a*, 11*b* and 11*c* is more variable in this regard and can be used both in drinking vessels with a circular drinking opening and with various geometries of the drinking opening. To this end, the elastic sealing member 62 is fixedly connected at the drinking straw 12 and consists, for example, of elastic latex material that can be stretched over the drinking opening of variously shaped drinking vessels and also seals these tightly at the top. If the elastic sealing member 62 has a corresponding elasticity, it can be put around the upper edge of the drinking vessel 100 with a correspondingly high elastic tension so that the liquid cannot slosh out of the drinking vessel 100 even in the case of strong movement.

Figure 12A:
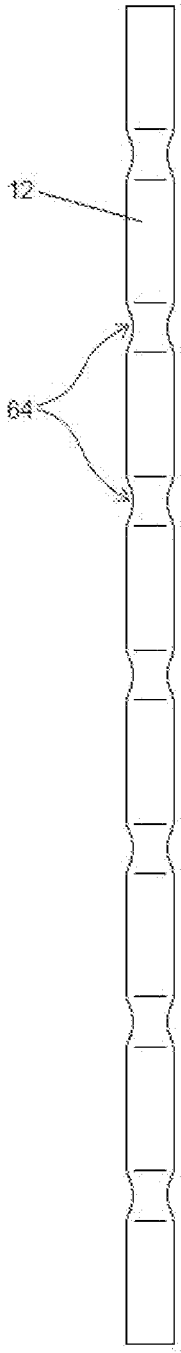
FIG. 12*a*, FIG. 12*b* and FIG. 12*c* a possible design of the drinking straw in two different configurations as well as a sectional view.
Figure 12B:
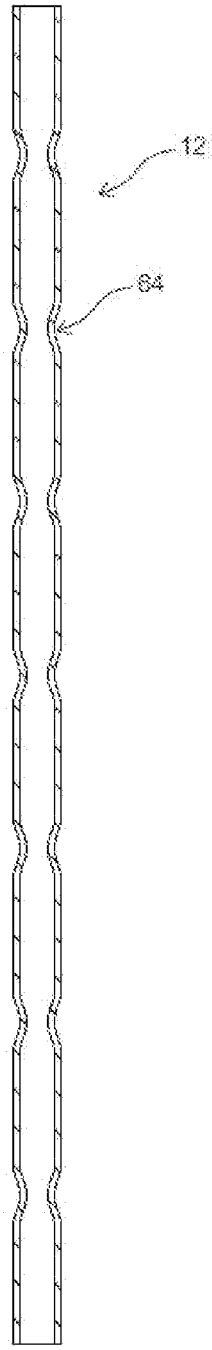
Figure 12C:
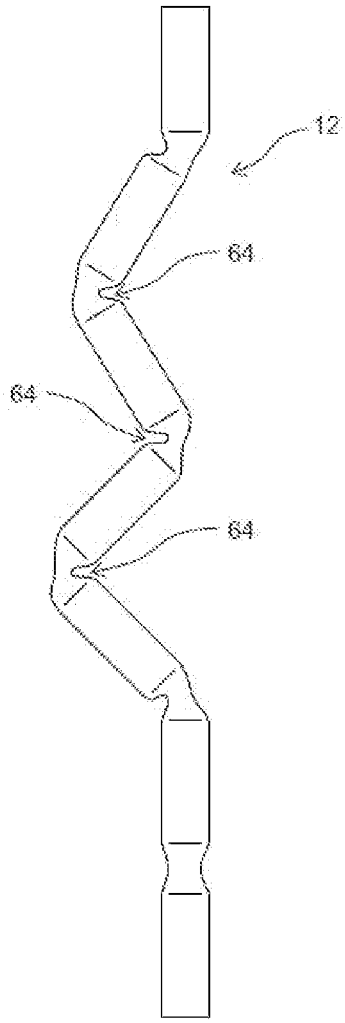

In FIGS. 12*a*, 12*b* and 12*c*, a drinking straw 12 is illustrated which is bendable since it has a plurality of predetermined bending points 64, preferably at regular intervals. By bending the drinking straw, as illustrated in FIG. 12*c*, at several of the predetermined bending points 64, it can be adjusted to drinking vessels with different geometries.

Figure 13A:
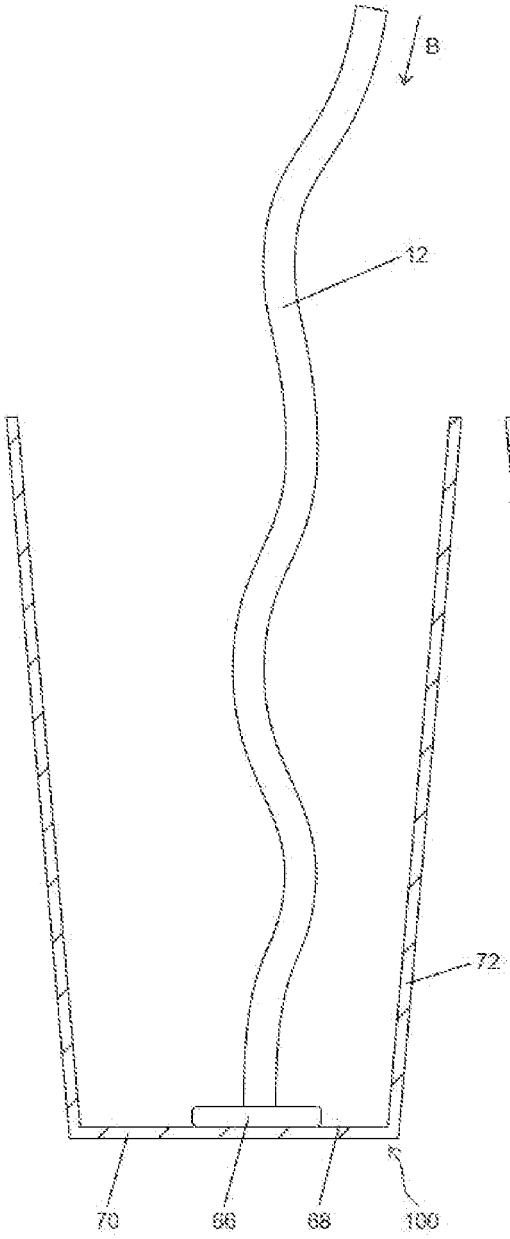
FIG. 13*a* and FIG. 13*b* a further embodiment of the drinking device according to the invention as well as the drinking vessel.
Figure 13B:
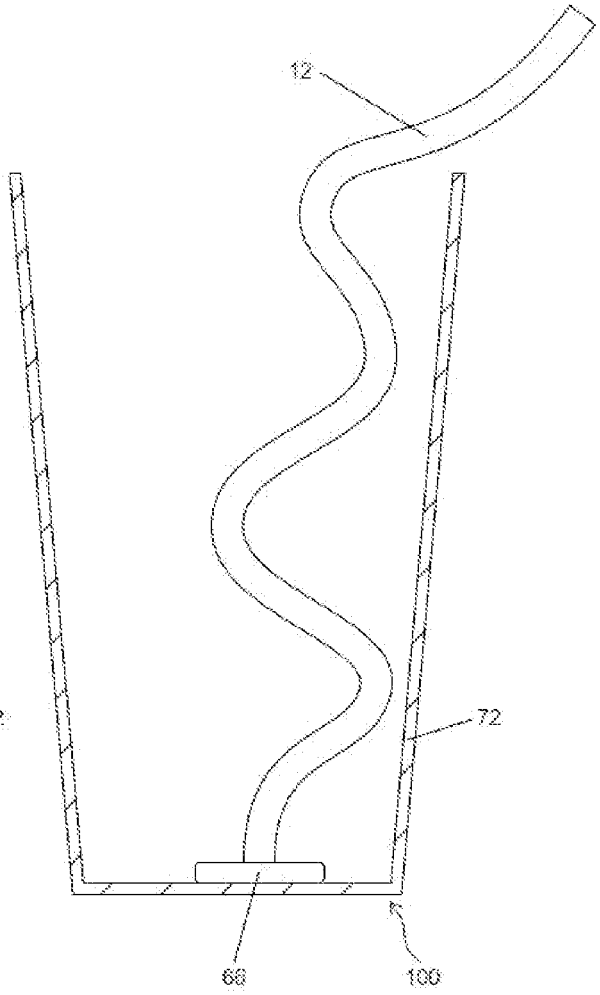

The embodiment according to FIGS. 13*a* and 13*b* shows a further possible configuration of the drinking straw 12 which is not provided with predetermined bending points as in the embodiment according to FIG. 12*a*, but is flexible and can adjust to any shape. Alternatively, it is also possible to configure the drinking straw in such a way that it can be adjusted in a desired shape to the drinking vessel 100. To this end, the user merely has to exert pressure force on the drinking straw 12 in the direction of the arrow B so that the drinking straw bends and remains in this position, as illustrated by means of the example in FIG. 13*b*.

Irrespective of the embodiment according to FIGS. 13*a* and 13*b* with a flexible drinking straw, a weight 66 can be provided at the drinking straw, which can also be present in all other embodiments. The weight is provided with a bearing surface 68 so that the weight rests flat on the bottom 70 of the drinking device 100. The weight has the function of holding the drinking straw deep in the liquid in the drinking vessel 100, and may additionally be used to rigidly receive the end of the drinking straw facing away from the drinking end so that the drinking straw does not rest against a side wall 72 of the drinking vessel 100 and stands, so to speak, in the drinking vessel.

Figure 14A:
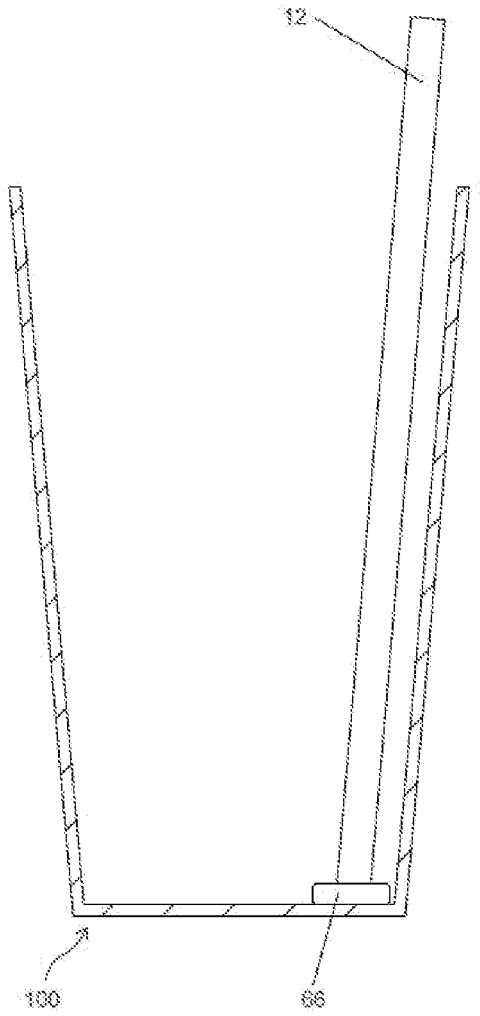
FIG. 14*a* and FIG. 14*b* a further embodiment of the drinking device according to the invention as well as the drinking vessel.
Figure 14B:
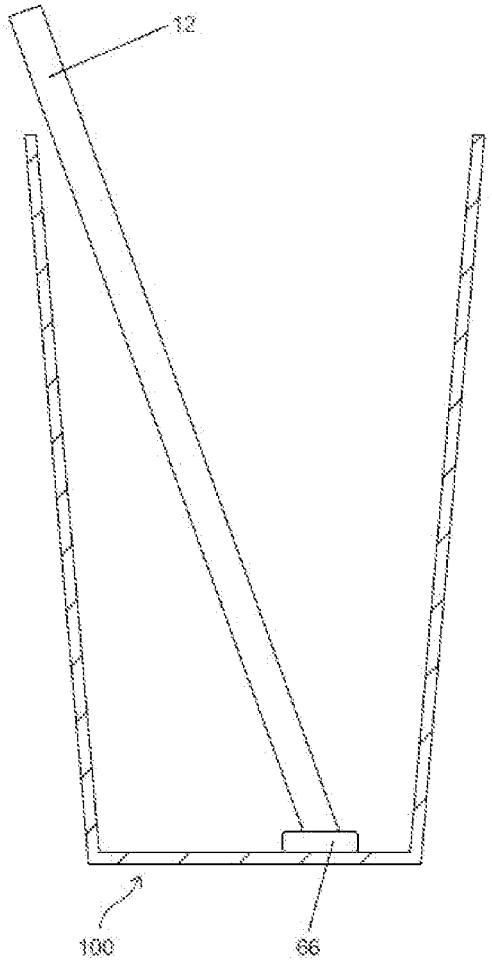

The use of a weight 66 with a rigid drinking straw is illustrated, by way of example, in FIGS. 14*a* and 14*b*. The rigid drinking straw 12 is held in the drinking vessel without tipping over.

Figure 15A:
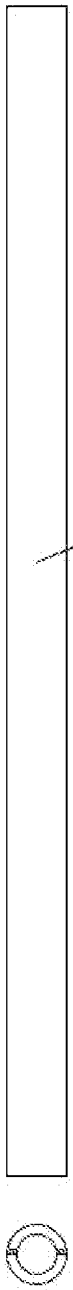
FIG. 15*a*, FIG. 15*b* and FIG. 15*c* a further possible configuration of the drinking straw in the closed state (FIG. 15*a*), partially open state (FIG. 15*b*) as well as in a detailed view (FIG. 15*c*)
Figure 15B:
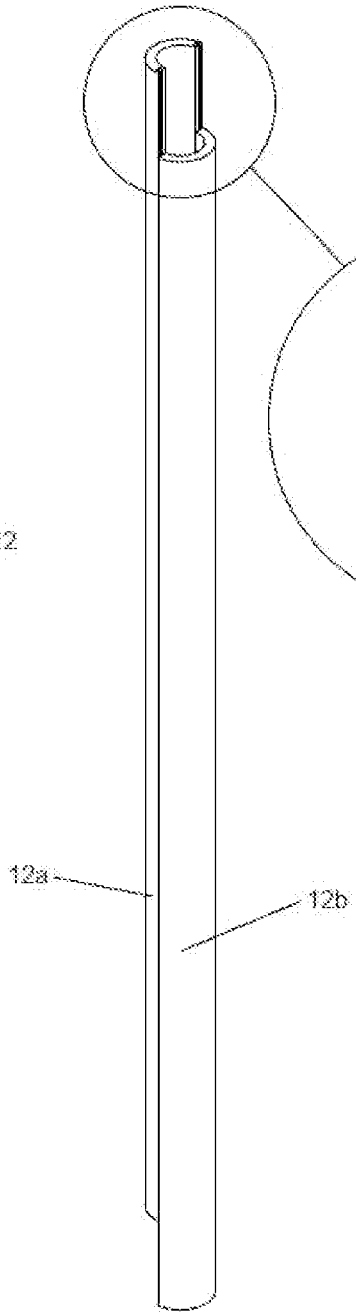
Figure 15C:
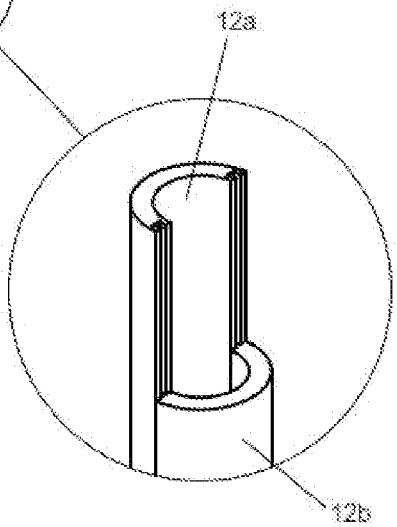
Figure 16A:
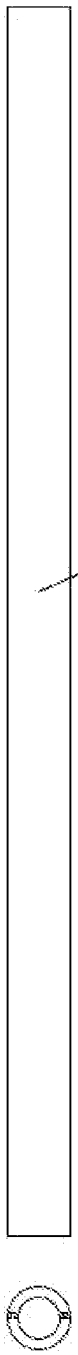
FIG. 16*a*, FIG. 16*b* and FIG. 16*c* a further possible configuration of the drinking straw in the closed state (FIG. 16*a*), partially open state (FIG. 16*b*) as well as in a detailed view (FIG. 16*c*)
Figure 16B:
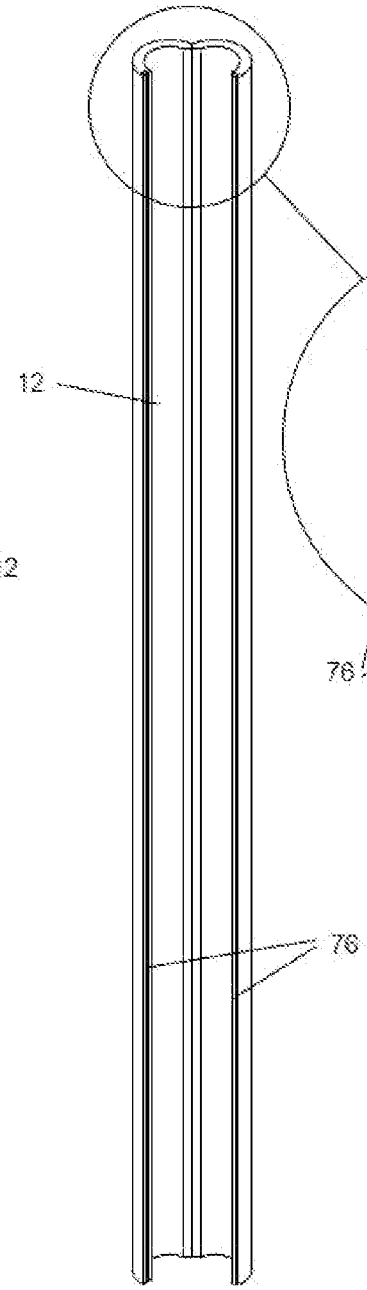
Figure 16C:
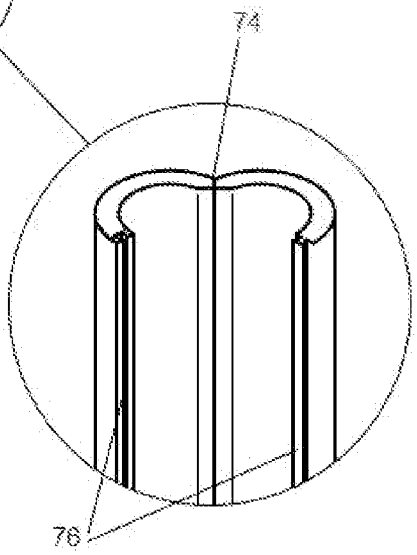

In FIGS. 15*a*, 15*b* and 15*c*, a drinking straw 12 is shown that can be divided into two parts 12*a* and 12*b*. To this end, the two U-shaped elements 12*a*, 12*b* are inserted into each other via a suitable tongue-and-groove connection and moved against each other in the longitudinal direction. The drinking straw that can be divided, according to FIGS. 15*a* to 15*c*, has the advantage that it can be cleaned more easily.

As an alternative to the embodiment of a drinking straw consisting of two partial elements, as illustrated in FIGS. 15*a*, 15*b* and 15*c*, the drinking straw can also have a film hinge 74 and have a tongue-and-groove connection point in the longitudinal direction so that the drinking straw can be opened and the wall limiting the inner flow channel can be easily cleaned.

Figure 17:
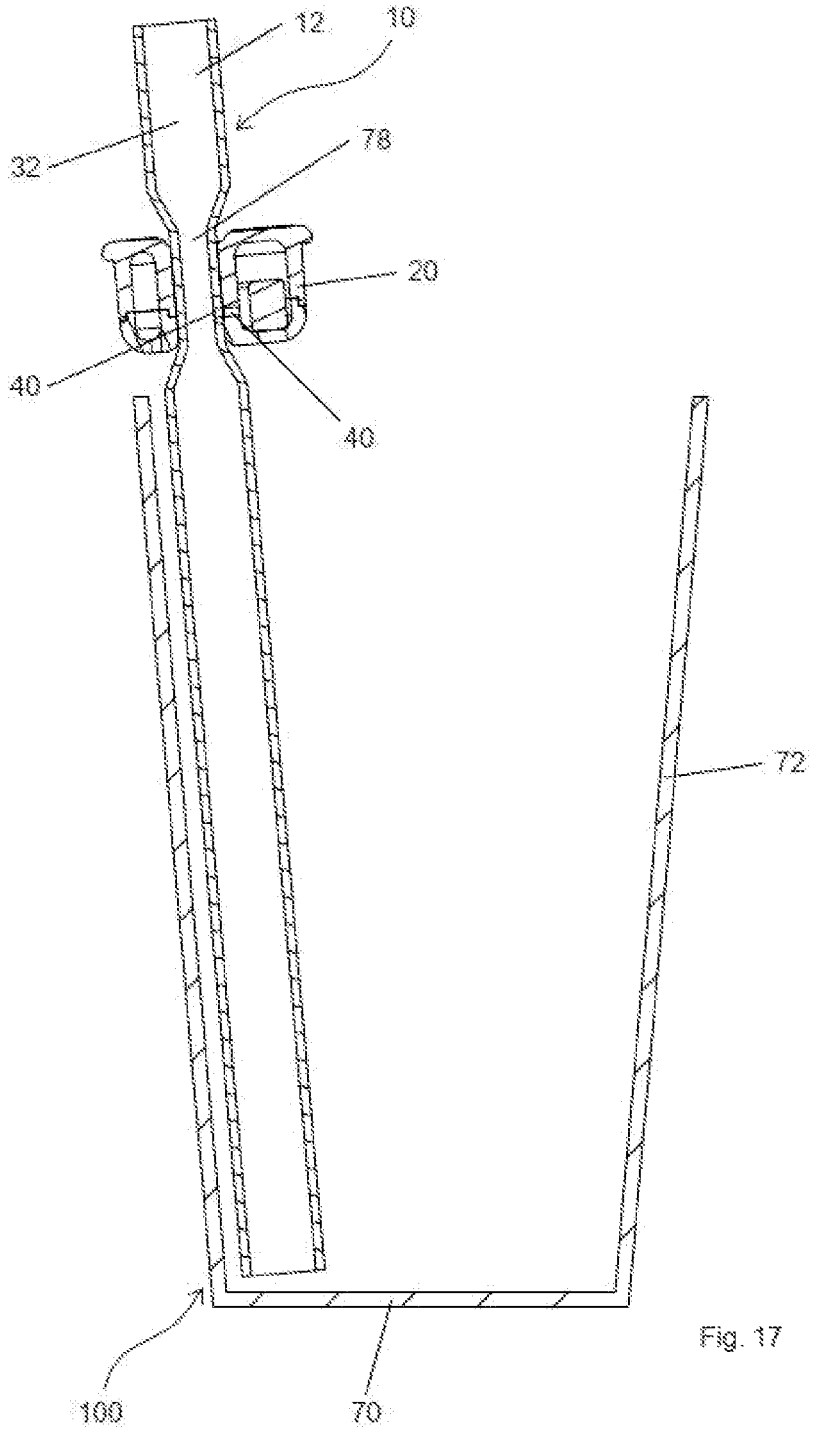
FIG. 17 a further possible configuration of the drinking device according to the invention in a drinking vessel.

In the embodiment according to FIG. 17, a drinking straw 12 is illustrated which has a tapered portion 78 at which the aroma container 20 is located. The tapered portion 78 fixes the position of the aroma container 20 in the longitudinal direction of the drinking straw 12. Moreover, a Venturi effect is created during the drinking process, in which—as described at the beginning—a suction effect is created in the narrowed portion 78 that serves to suck aromatized air from the air outlet opening 40 and through the aroma inlet opening 42 from the aroma container 20 into the inner flow channel 32 of the drinking straw 12.

The essentially annular aroma container surrounding the drinking straw can be opened via a film hinge so that it can be attached around the narrowed portion 78 of the drinking straw 12. Alternatively, the narrowed portion can be located only the area of the inner flow channel, while the outer contour is not narrowed there, so that an aroma container with a circular ring-shaped cross-section can be slid onto the drinking straw in the longitudinal direction.

Figure 18:
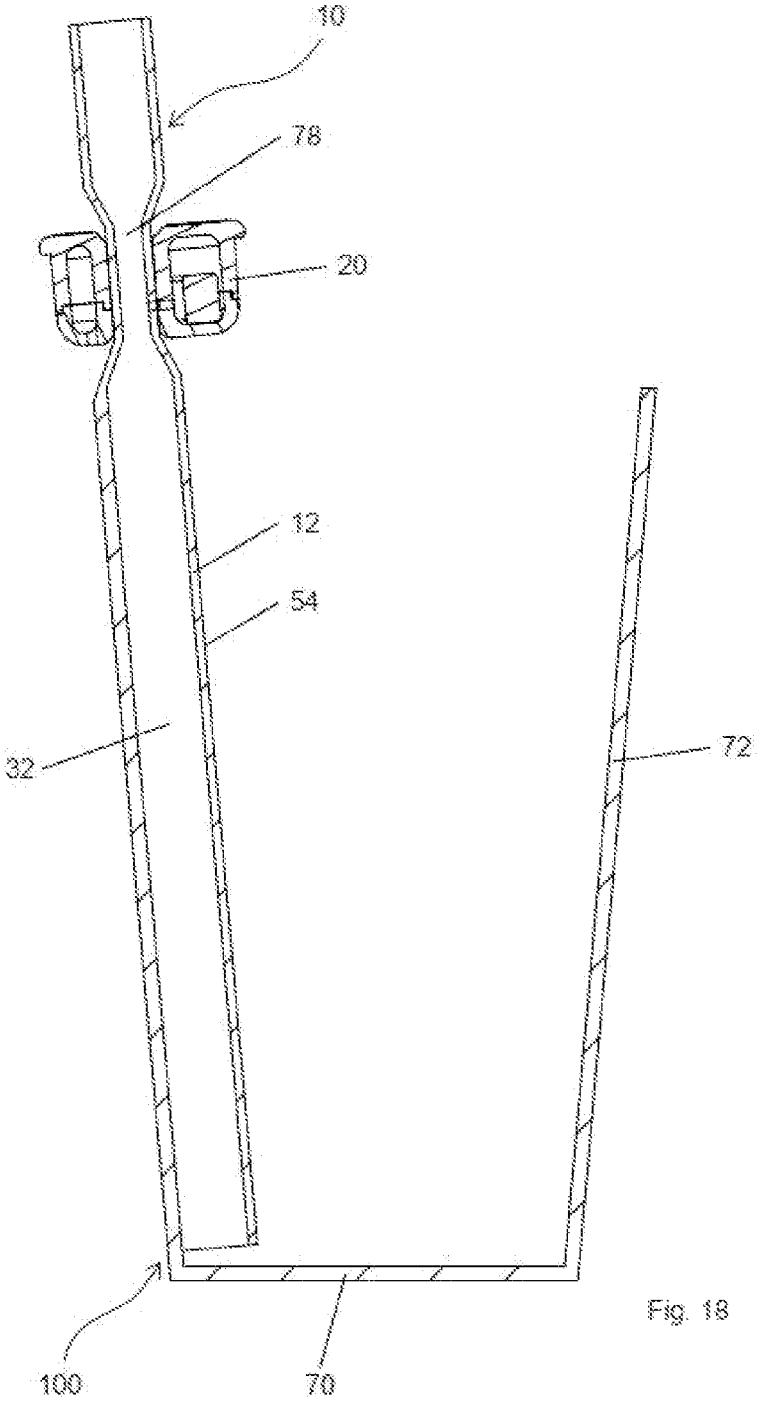
FIG. 18 a drinking vessel with an integrated drinking device.

The embodiment according to FIG. 18 differs from the embodiment according to FIG. 17 in that the drinking vessel 100 according to the invention is formed integrally with the drinking device 10. The inner flow channel 32 is formed between a side wall 72 of the drinking device and the wall 54 of the drinking straw so that the drinking device 10 is a fixed component of the drinking vessel 100.

If the drinking vessel is also tightly sealed with a lid (not shown), the drinking vessel can also be tilted without the drinking liquid leaking out of the drinking straw.

The embodiment according to FIG. 18 with an integral configuration of drinking straw and drinking vessel is based, by way of example, on the design of the drinking device 10 according to FIG. 17. However, it should be clear that the drinking device 10 formed integrally with the drinking vessel 100 can also be realized in many of the preceding embodiments of the drinking device 10. The same applies to the provision of a mouthpiece that can also be provided in all embodiments.

A configuration not illustrated in the figures provides an essentially annular aroma container that can be opened up into two half-shells by means of a film hinge and that has a pointed, cannula-shaped portion in the area of the air outlet opening and can be closed around a drinking straw, whereby the cannula-shaped protruding portion penetrates the wall of the drinking straw 12 and creates the flow connection between the aroma chamber and the inner flow channel of the drinking straw. This embodiment has the advantage that the aroma container can be used with conventional drinking straws to the outer diameter of which it can be adjusted. By closing the aroma container and the penetration of the outer wall of the drinking straw, not only the flow connection between the aroma chamber and the inner flow channel of the drinking straw is created, but the aroma container is also fixed in position relative to the drinking straw.

LIST OF REFERENCE NUMBERS

10 drinking device
12 drinking straw
14 mouthpiece
16 recess
17 drinking end of the drinking straw
20 aroma container
22 conical receiving area
24 coupling member
26 receptacle
28 drinking end of the mouthpiece
30 stop at the mouthpiece
32 inner flow channel
34 outer wall of the receptacle
36 inner wall of the receptacle
38 aroma channel
40 air outlet opening
42 aroma inlet opening
44 aroma chamber
46 carrier substance
48 head space
50 air inlet opening
52 stop
54 wall of the drinking straw
56 wall of the aroma container
58 conical sealing member
60 drinking opening
62 elastic sealing member
64 predetermined bending point
66 weight
68 bearing surface
70 bottom
72 side wall
74 film hinge
76 tongue-and-groove connection point
78 narrowed portion
100 drinking vessel

The invention claimed is:

1. A drinking device consisting essentially of:

a drinking straw with an inner flow channel and a drinking end; and an aroma container fixedly or detachably connected with the drinking straw for adding an aroma substance to an air flow flowing out of the aroma container; wherein the aroma container includes at least one air outlet opening which is in flow connection with an aroma channel extending up to the drinking end of the drinking straw, the aroma channel being separate from the inner flow channel; wherein the aroma container is adapted to be coupled with the drinking straw in such a way that, when applying a negative pressure at the drinking end of the drinking straw or when applying a negative pressure at a mouthpiece connected with the drinking end of the drinking straw, the air flow exits from the aroma container through the at least one air outlet opening; and the aroma container includes an aroma chamber containing a carrier substance for an aroma substance.

2. The drinking device according to claim 1, wherein the aroma container is movable relative to the drinking straw between an activated position and a non-activated position, wherein only in the activated position the at least one air outlet opening is in flow connection with the at least one aroma inlet opening or the aroma channel.

3. The drinking device according to claim 2, wherein the aroma container is movable relative to the drinking straw along a longitudinal direction of the drinking straw.

4. The drinking device according to claim 1, wherein the aroma container includes the mouthpiece.

5. The drinking device according to claim 4, wherein the aroma container has a conically shaped receiving area for attaching the drinking straw.

6. The drinking device according to claim 1, wherein the drinking straw includes the aroma channel which is provided separately from the inner flow channel and ends at the drinking end of the drinking straw.

7. The drinking device according to claim 1, wherein the aroma container includes the aroma channel.

8. The drinking device according to claim 1, wherein the aroma container is formed between a first boundary wall surrounding the inner flow channel of the drinking straw and a second boundary wall formed by the aroma container.

9. The drinking device according to claim 1, further comprising a sealing member at the drinking straw, which extends around the drinking straw and is suited to be mountable on drinking vessels with different diameters.

10. The drinking device according to claim 9, wherein the sealing member is a continuously conical or stepped conical, rotationally symmetrical member.

11. The drinking device according to claim 9, wherein the sealing member is an elastic sealing grommet.

12. The drinking device according to claim 1, wherein the drinking straw is dividable in the longitudinal direction.

13. The drinking device according to claim 1, wherein the drinking straw has a film hinge which extends in the longitudinal direction and is configured to be opened in the longitudinal direction.

14. The drinking device according to claim 1, wherein the drinking straw has a plurality of predetermined bending points.

15. The drinking device according to claim 1, wherein the drinking straw is elastically deformable.

16. The drinking device according to claim 1, wherein the drinking straw includes a weight at end opposite in a longitudinal direction to the drinking end thereof, the weight having a bearing surface for resting on an inner bottom of a drinking vessel.

17. The drinking device according to claim 1, wherein the drinking straw has a receptacle for the aroma container, into which the aroma container can be inserted.

18. The drinking device according to claim 1, wherein the drinking straw includes a first longitudinal portion and a second longitudinal portion, wherein the aroma container is attachable between the first longitudinal portion and the second longitudinal portion of the drinking straw.

19. The drinking device according to claim 1, wherein the aroma container is mounted on the drinking straw, wherein the aroma container includes a penetration member configured to penetrate the drinking straw when mounting the aroma container on a drinking straw and to create the aroma inlet opening.

20. The drinking device according to claim 19, wherein the aroma container is clipped on the drinking straw.

21. The drinking device according to claim 1, wherein the inner flow channel of the drinking straw in some areas has a narrowing of the cross-section in the region of the aroma inlet opening.

22. The drinking device according to claim 1, wherein the carrier substance has a specific flow resistance of less than 500 Pa·s/m.

23. The drinking device according to claim 22, wherein the carrier substance has a specific flow resistance of less than 400 Pa·s/m.

24. The drinking device according to claim 23, wherein the carrier substance has a specific flow resistance of approximately 380 Pa·s/m.

25. A drinking vessel comprising:

a bottom and at least one side wall extending from the bottom upwards and limiting a volume for receiving drinking liquid; and a drinking device according to claim 1.

26. The drinking vessel according to claim 25, wherein the drinking straw of the drinking device is fixedly connected with the side wall of the drinking vessel.

27. The drinking vessel according to claim 26, wherein a side wall of the drinking vessel directly limits the inner flow channel in some areas.

* * * * *